US008539692B1

(12) United States Patent
Huebner

(10) Patent No.: US 8,539,692 B1
(45) Date of Patent: Sep. 24, 2013

(54) CONSTRUCTION FOR A PERMEABLE FLEXIBLE LINER FOR A MODULAR PRESERVER SYSTEM

(76) Inventor: Michael James Huebner, Marietta, GA (US)

( * ) Notice: Subject to any disclaimer, the term of this patent is extended or adjusted under 35 U.S.C. 154(b) by 491 days.

(21) Appl. No.: 12/802,838

(22) Filed: Jun. 14, 2010

Related U.S. Application Data

(63) Continuation-in-part of application No. 12/321,176, filed on Jan. 14, 2009, now Pat. No. 8,099,879, and a continuation-in-part of application No. 12/286,264, filed on Sep. 29, 2008, now Pat. No. 7,930,837.

(60) Provisional application No. 61/204,739, filed on Jan. 9, 2009.

(51) Int. Cl.
*A43B 3/00* (2006.01)
*A43D 3/00* (2006.01)

(52) U.S. Cl.
USPC ..... 34/95; 34/95.1; 34/105; 12/128 R; 12/128 B; 12/114.2

(58) Field of Classification Search
USPC ..... 34/95, 95.1, 105, 329, 353, 355; 12/128 R, 128 B, 114.2; 36/3 R
See application file for complete search history.

(56) References Cited

U.S. PATENT DOCUMENTS

| | | | | |
|---|---|---|---|---|
| 2,565,028 | A * | 8/1951 | Keithley, Jr. | 36/3 A |
| 3,131,036 | A * | 4/1964 | Hirschberg | 34/95.1 |
| 6,893,632 | B2 * | 5/2005 | Johnson | 424/76.1 |
| 7,699,913 | B2 * | 4/2010 | Grieve et al. | 96/147 |

* cited by examiner

*Primary Examiner* — Jiping Lu
(74) *Attorney, Agent, or Firm* — Robert Z. Evora, Esq.

(57) ABSTRACT

A construction for a permeable liner within a modular shoe preserver system having interchangeable components. The preserver adapted to snugly fit within a shoe including a permeable covering, a permeable liner and an absorbing material. The permeable liner is disposed within the permeable covering. The permeable liner is constructed from an expandable material having a closed heel end and an open toe end adapted to receive an absorbent material. In construction, the open toe end of the permeable liner is folded various times before it is closed to define a forefoot end having a material mass substantially thicker and wider than the remainder of the permeable liner that resembles that of a forefoot. The absorbing material is disposed within the permeable liner to withdraw moisture from an interior surface area of the shoe.

15 Claims, 25 Drawing Sheets

FIG. 3
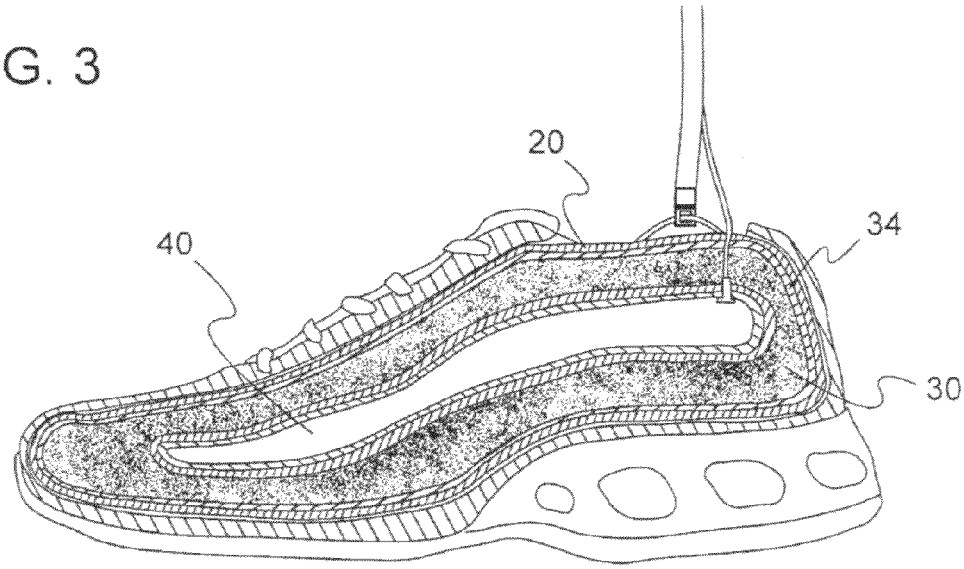
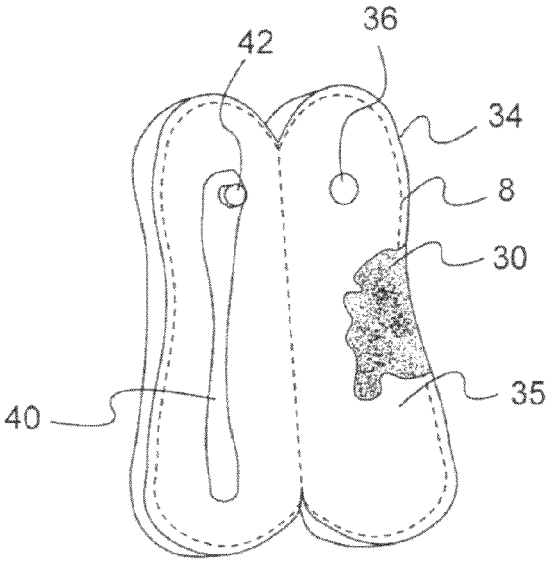
FIG. 4
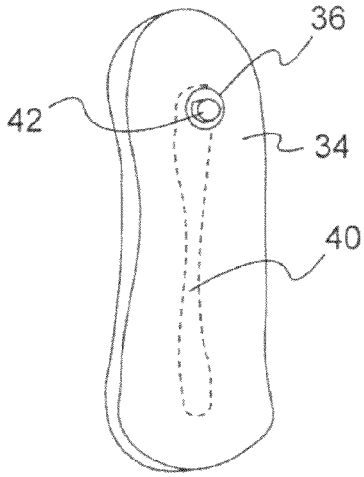
FIG. 5

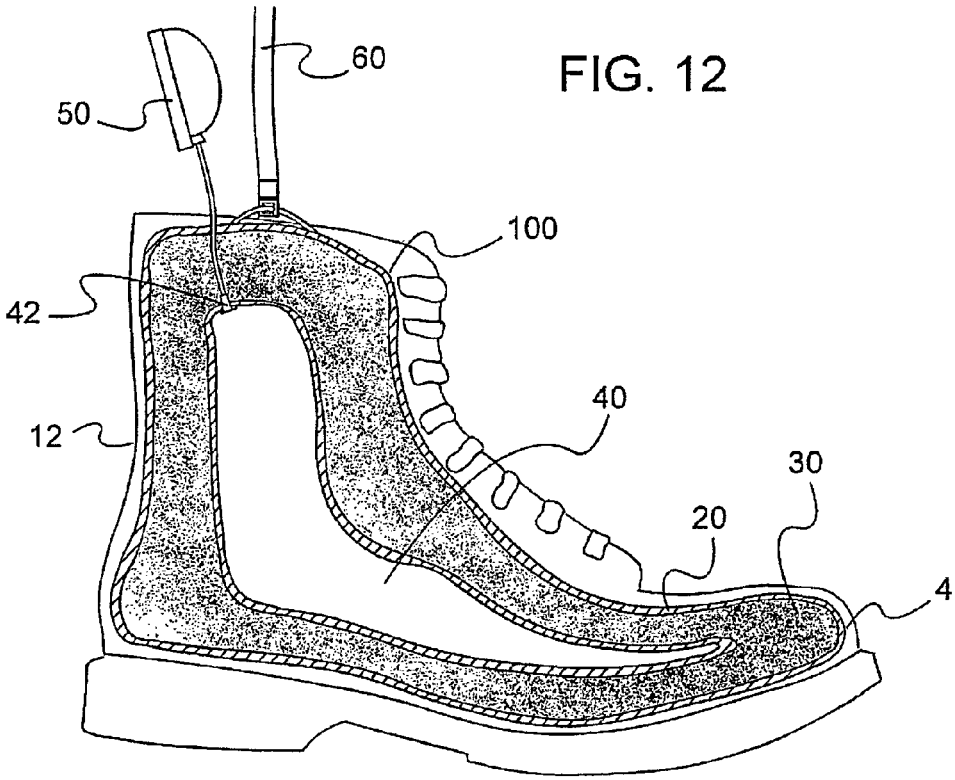
FIG. 12
FIG. 13
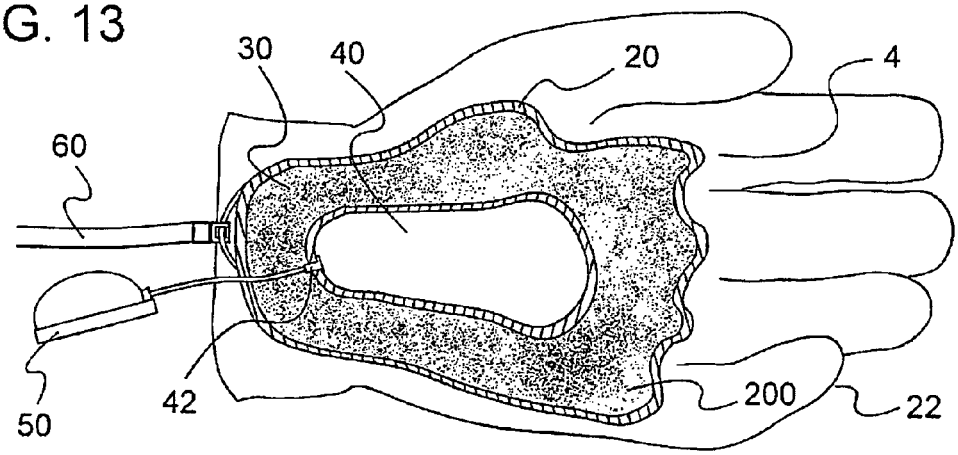

FIG. 56
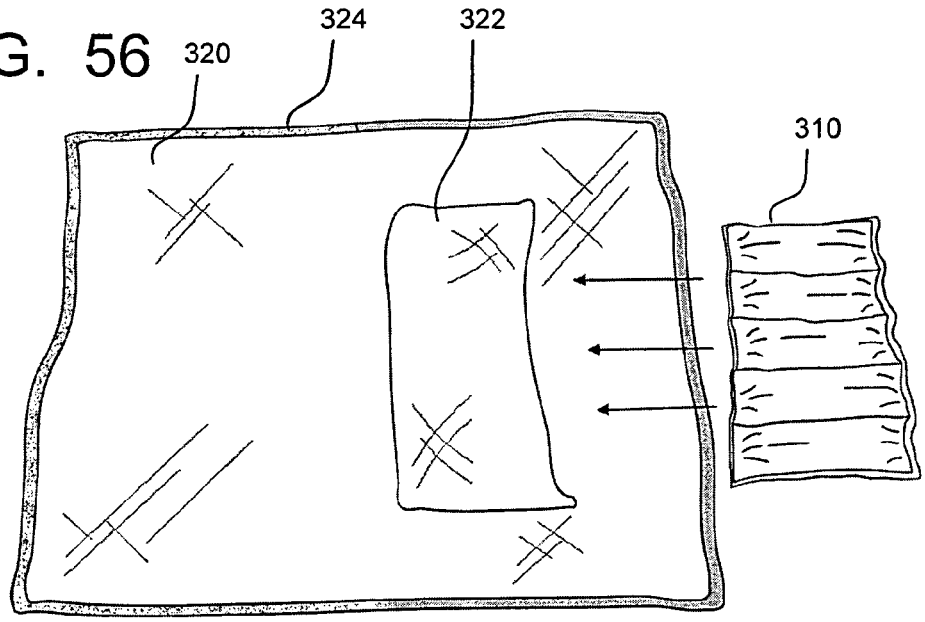
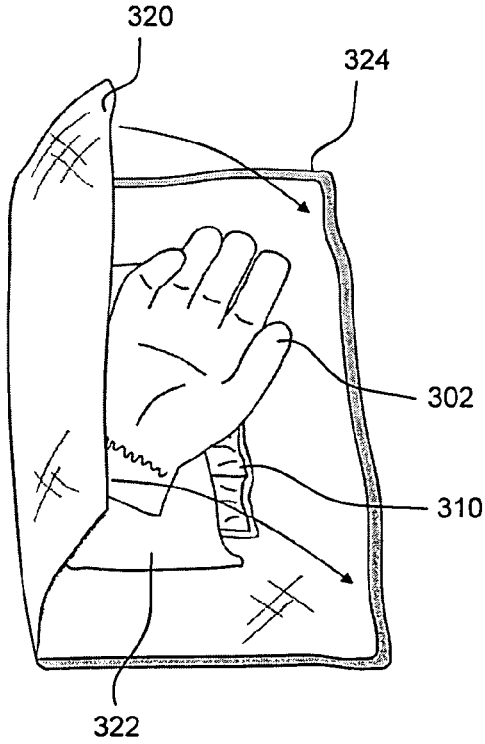
FIG. 57

CONSTRUCTION FOR A PERMEABLE FLEXIBLE LINER FOR A MODULAR PRESERVER SYSTEM

CROSS REFERENCE TO RELATED APPLICATION

This application is a Continuation-in-Part Application which incorporates by reference all of the subject matter of U.S. Non-Provisional application Ser. No. 12/321,176, entitled "Modular Preserver System" filed Jan. 14, 2009 now U.S. Pat. No. 8,099,879. This application also incorporates by reference all of the subject matter of U.S. Provisional Application Ser. No. 61/204,739, entitled "Modular Preserver System" filed Jan. 9, 2009. This application further incorporates the subject matter of Continuation-in-Part Application which claims the benefit of the filing date of U.S. Non-Provisional application Ser. No. 12/286,264, entitled "Preserver Including An Expandable Bladder" filed Sep. 29, 2008 now U.S. Pat. No. 7,930,897.

BACKGROUND OF THE INVENTION

1. Field of the Invention

This invention relates to a preserver system, and more particularly, to the construction for a permeable flexible liner for the modular preserver system, which is adapted maximize the draw of moisture from all interior surfaces of the protective covering, such as a shoe, boots, gloves, a helmet, a shin guard, a head band, wrestling head gear, and the like.

2. Description of the Related Art

Various solutions have been proposed to deodorize, and remove moisture from a shoe. For example, U.S. Pat. No. 5,291,669 to Khoury et al. discloses a shoe preserver having a wicking portion and an absorbing portion retained within a flexible porous covering. However, the shoe preserver of Khoury et al. is not expandable to snugly fit within shoes of various sizes and shapes. Khoury et al. shoe preserver is not modular and not specifically made for a particular size and shape of a shoe. Furthermore, since the Khoury et al. shoe preserver is not expandable, it cannot completely come in contact with all interior surfaces of a shoe thereby limiting the ability of the shoe preserver to maximize that moisture drawn from within the shoe. Khoury et al. also fails to provide any protective covering to shield objects that would otherwise come in contact with a dirty shoe.

Likewise, the following other conventionally devices are also not modular and also fail to provide any protective covering over the shoe and/or solution to maximize the amount of moisture being drawn from within the interior of a shoe. U.S. Pat. No. 3,131,036 to Hirschberg discloses a shoe drying device having a porous semi-rigid plastic foam wherein the foam defines a cavity which is filled with a powdered desiccant material. U.S. Pat. No. 896,536 to Hayden discloses a shoe tree having an absorbent sponge material surrounded by a porous fabric, wherein a wooden block or piece is disposed within the sponge material to provide for insertion and removal of the shoe tree. U.S. Pat. No. 2,173,528 to Beale discloses a disinfectant pad including an absorbent material enclosed by a porous covering.

There is still a longstanding need to solve this problem. In accordance with this invention, an exemplary construction for a permeable flexible liner for the moisture absorbing preserver modular system. The permeable flexible liner construction is adapted to suitably fill the enlarged space defined by a forefoot of person's foot. The permeable flexible liner contributes to deodorizing and substantially maximizing the draw of moisture from all interior surfaces of various protective coverings, such as a shoe, boots, gloves, a helmet, and the like.

SUMMARY OF THE INVENTION

A construction for a permeable liner within a modular shoe preserver system having interchangeable components. The preserver adapted to snugly fit within a shoe including a permeable covering, a permeable liner and an absorbing material.

The permeable liner is disposed within the permeable covering. The permeable liner is constructed from an expandable material having a closed heel end and an open toe end adapted to receive an absorbent material. In construction, the open toe end of the permeable liner is folded various times before it is closed to define a forefoot end having a material mass substantially thicker and wider than the remainder of the permeable liner that resembles that of a forefoot. The absorbing material is disposed within the permeable liner to withdraw moisture from an interior surface area of the shoe.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein:

FIG. 3 illustrates a side view of the preserver in an inflated state including an enclosed compartment for an absorbent material in accordance with this invention.

FIG. 4 illustrates a laid-open view of the permeable flexible liner forming a compartment for receiving a bladder therein in accordance with this invention.

FIG. 5 illustrates a closed view of the permeable flexible liner including a compartment disposed with the absorbent material and a bladder wrapped therein in accordance with this invention.

FIG. 12 is a cross-section view of a preserver and the flexible strap adapted for use with a boot in accordance with this invention.

FIG. 13 is a cross-section view of a preserver and the flexible strap adapted for use with a pair of gloves in accordance with this invention.

FIG. 56 shows a length of cloth includes a pocket into which a piece of the modular sheet is placed into the pocket FIG. 57 illustrates the soiled protective covering placed within the folded cloth and over the moisture absorbing modular sheet

DETAILED DESCRIPTION OF EXEMPLARY EMBODIMENTS

Particular embodiments of the present invention will now be described in greater detail with reference to the figures.

In accordance with this invention, it is to be understood that the preserver described herein may be adapted for use with various different types of protective coverings, and that the various embodiments described and shown herein are not intended to cover all modifications and changes within the scope and spirit of the invention.

Figure 1:
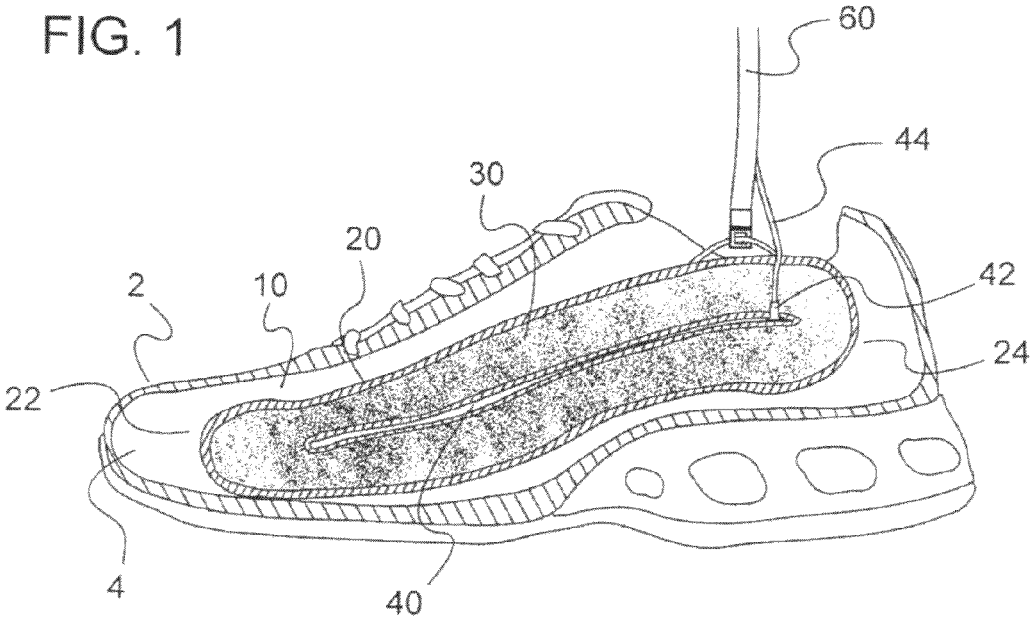
FIG. 1 illustrates a side view of the preserver in a deflated state in accordance with this invention.

FIG. 1 illustrates an exemplary shoe preserver 10 for a shoe 2 in a deflated state. As shown in the deflated state, the preserver 10 resembles the shape of a shriveled foot and includes a toe portion, a heel portion, a sole portion, and a tongue portion. The shoe preserver 10 further includes a permeable flexible covering 20, an absorbing material 30, and a bladder 40.

Figure 2:
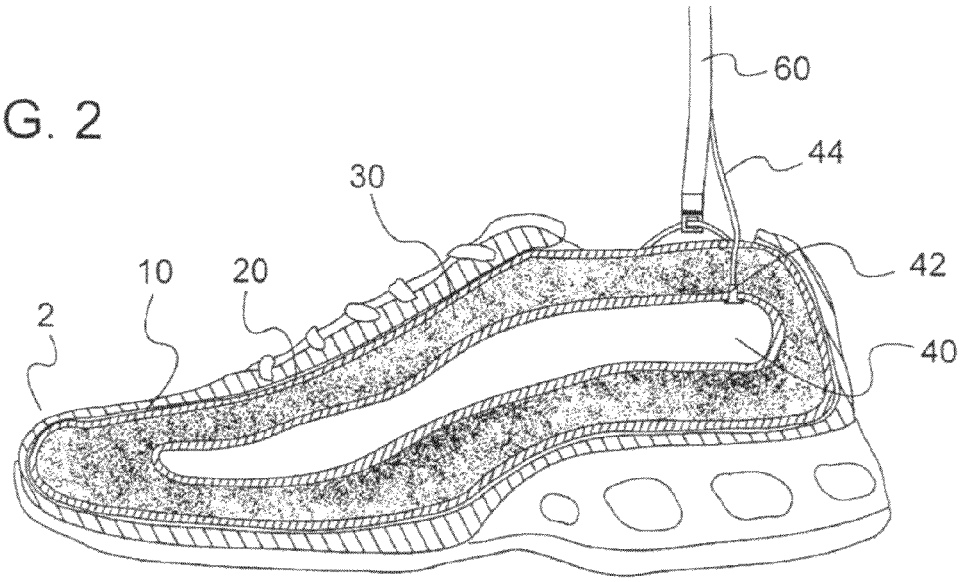
FIG. 2 illustrates a side view of the preserver in an inflated state in accordance with this invention.

FIG. 2 depicts the shoe preserver 10 in an operable inflated state in accordance with this invention. As shown in FIGS. 1 and 2, the permeable flexible covering 20 is substantially configured in the shape of a foot. The permeable flexible covering 20 includes a toe end 22 sized to be disposed within the forefoot of the shoe 2 and a heel end 24 sized to placed within the heel portion of the shoe 2.

As shown in the deflated state in FIG. 1, the permeable flexible covering 20 is sized and resembles a shriveled foot. The permeable flexible covering 20 and the permeable flexible liner 34 are made from a resilient expandable material and can be expanded to fill the entire volume defined by the interior surface area 4 of the shoe 2 (as shown in FIG. 2). In the deflated state of FIG. 1, the shoe preserver 10 only nominally comes into contact with the internal surface area 4 of the shoe 2. However, in operation and as shown in FIG. 2, when the bladder 40 of the shoe preserver 10 is inflated, the permeable flexible covering 20 and hence the shoe preserver 10 expands and fills the entire volume and internal surface area 4 of the shoe 2. In the inflated state, the shoe preserver 10 comes into direct contact with all of the internal surfaces 4 of the shoe 2.

The permeable flexible covering 20 and the permeable flexible liner 34 may be formed from any number of flexible porous material, including but not limited to for example, nylon, spandex, cotton, polyester, polyester swiss pique, and/or any other flexible expandable and porous material, now known or later discovered in accordance with this invention. Another aspect of the permeable flexible liner 34 and the permeable flexible covering 20 is to use a material that is capable of providing sufficient flexibility so that when the bladder 40 (as described in more detail later) expands, the permeable flexible covering 20 can likewise expand to fill the internal compartment of the protective covering such that all internal surfaces may come into contact with the expanded permeable flexible covering 20. The permeable flexible covering 20 may also be capable of allowing aromatic scents there though while preventing the material substance containing the aromatic and/or deodorant from escaping across the permeable flexible covering 20 from within the preserver 10.

The absorbing material 30 is disposed within the permeable flexible covering 20 and is provided to withdraw and retain moisture from within the interior surface area 4 of the shoe 2. The absorbing material 30 may be selected from any number of absorbent, including but not limited to for example, sponge, cotton, foam, gel, cedar chips, a wicking material, and any other suitable absorbent material that biases moisture from the interior surface area of a shoe into the absorbing material, now known or later discovered in accordance with this invention.

It is within the scope of this invention to integrate a separate and/or combined wicking member (not shown) with the absorbing material 30 such that the absorbing material 30 will act to draw, or/or retain moisture from the wicking member from the interior of the shoe 2 into the absorbing material 30.

FIGS. 3-5 illustrate another aspect of this invention in which the absorbing material 30 may be constructed to be self contained separate unit within a permeable flexible liner 34. The flexible liner 34 may be positioned between the permeable flexible covering 20 and the bladder 40. In this construction, the absorbing material 30 may be disposed to evenly encase the bladder 40 such that the absorbing material 30 within the permeable flexible liner 34 may be evenly distributed within the interior volume of the shoe 2 when the bladder 40 is expanded.

The permeable flexible liner 34 may be formed as a compartment 35 by stitching 8 the permeable flexible liner 34 to form the compartment 35 into which the absorbing material 30 may be received, as shown in FIG. 4. FIG. 5 depicts the permeable flexible liner 34 in a closed configuration through whish the inlet vale 42 is extended through an orifice 36 in the permeable flexible liner 34.

Figure 6:
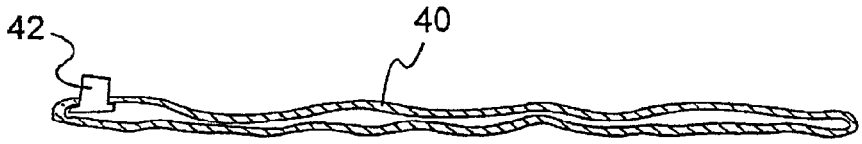
FIG. 6 is a side view of a deflated bladder including an inlet valve for receiving a source of air in accordance with this invention.
Figure 7:
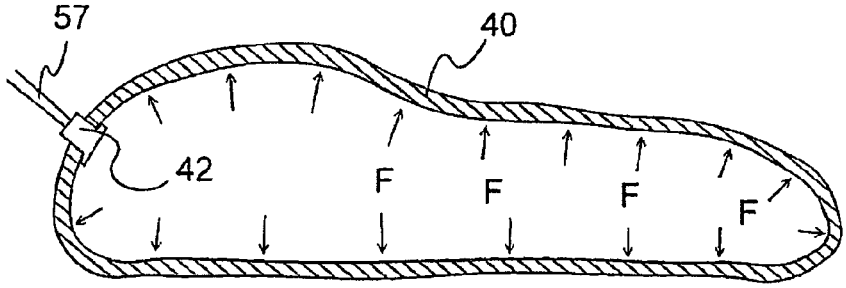
FIG. 7 is a side view of an inflated bladder including an inlet valve for receiving a source of air depicting the distributed pressure force on the bladder in accordance with this invention.

FIGS. 6-7 illustrate the bladder 40 in a deflated and an inflated state, respectively. The bladder 40 includes an inlet valve 42 adapted to receive air from an external source, which in turn expands the shoe preserver 10 to a size that completely fills the interior surface area 4 of the shoe 2, as shown in FIG. 2.

The bladder 40 may be inflated in a variety of different ways. In FIG. 6, the bladder 40 is shown substantially deflated having little air disposed therein. In FIG. 7, the bladder 40 is shown substantially inflated by an external source of air. In the shoe 2, the inflated bladder 40 is expanded so that the permeable flexible covering 20 completely fills the interior surface area 4 of the shoe 2. The bladder 40 is positioned so that when it is inflated the bladder is located central to the absorbing material 30 and urges the absorbing material 30 against the inner surface area of the shoes 4.

The bladder 40 may be inflated by manually blowing air into the inlet valve 42 by mouth until the permeable flexible covering bladder 40 expands from the deflated to the inflated state (as shown in FIGS. 6-7) to completely fill the interior surface area 4 of the shoe 2. Alternatively, and as described later, the bladder may be filled by an external pump.

The internal air disposed within the bladder 40 creates an internal pressure force (F, as shown in FIG. 7) within the bladder 40 that is transferred to the shoe preserver 10 that is evenly distributed outward throughout the interior surface area 4 of the shoe 2. The internal pressure force (F) causes the shoe preserver 10 to be securely wedged into the shoe 2. As a result of the built up internal pressure force (F) and the resultant forces acting against the shoe preserver 10, the shoe preserver 10 is securely lodged within the shoe 2 and therefore prevented from slipping out of the shoe 2. The internal pressure force (F) generated by the air pressure in the bladder 40 is substantially strong enough to overcome the exertion of a significantly strong perpendicular forces directed out of the ankle opening of the shoe 2, which would otherwise cause the shoe preserver 10 to be dislodged from the shoe 2.

Figure 8:
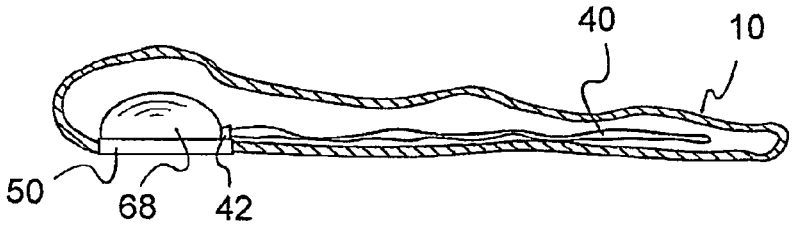
FIG. 8 is a side view of a deflated bladder including a pump disposed outside of the shoe preserver in accordance with this invention.
Figure 9:
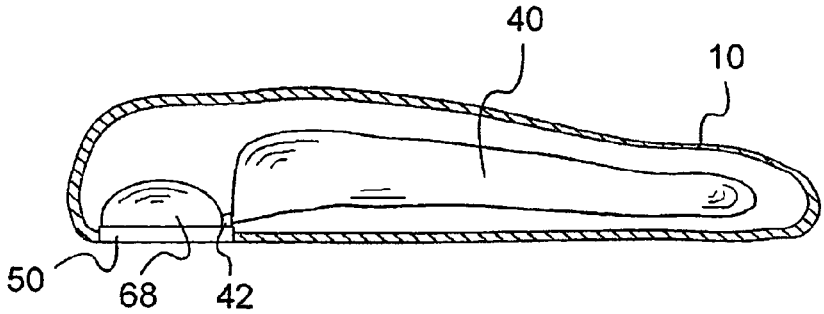
FIG. 9 is a side view of an inflated bladder including a pump disposed inside of the shoe preserver in accordance with this invention.

FIGS. 8-9 depict a simplified pump 50 as another exemplary source for producing air within the bladder 40. In FIGS. 8-9, the pump 40 is integrated as a part of the inlet valve 42 attached to the bladder 40. As shown, the bladder 40 may be inflated by repeatedly compressing a resilient bulb 68 of the pump 50 until the shoe preserver 10 completely fills the interior surface area 4 of the shoe 2.

The pump 50 may be implemented in a variety of different constructions. For example, as shown in FIGS. 8-9, the pump 50 may be integrated as part of the inlet valve 42 and the bladder 40. The pump 50 may be disposed within (as shown in FIGS. 8-9) the shoe preserver 10 and/or on an outer surface (not shown) of the preserver 10 in accordance with this invention.

The location of the pump 50 within the preserver 10 is optimally positioned so that the pump 50 is accessible for use when the preserver 10 is installed in the shoe 2. Various design constructions may be implemented to optimally position the pump 50 in an accessible position when the pump 50 is disposed within the preserver 10. For example, the pump 50 and/or portion thereof may be positioned by being fastened into the preserver 10, such as by being sewn 8 therein (as shown in FIGS. 8-9). As shown in FIGS. 6-7, the inlet valve 42 to the bladder 40 may be optimally positioned to stand adjacent to the ankle opening of the shoe 2. In use, the pump 50 may be attached to the bladder 40 through the ankle opening as shown in FIGS. 1-2. In the alternative, a pouch and/or compartment (not shown) may be formed in which the pump 50 may be placed so that it is always accessible so that the user can inflate the preserver 10.

In the alternative, the pump 50 may be a separable component constructed to work in combination with the preserver 10, 100, 200, 300, 400, 500 as a separate pump system component disconnected from the preserver, as shown in FIGS. 12-15. It is to be understood that various types of pumps may be used in accordance with this invention, including but not limited to, a bicycle pump, an electric pump, a manual pump and/or any other pump now known or later discovered in accordance with this invention.

Figure 10:
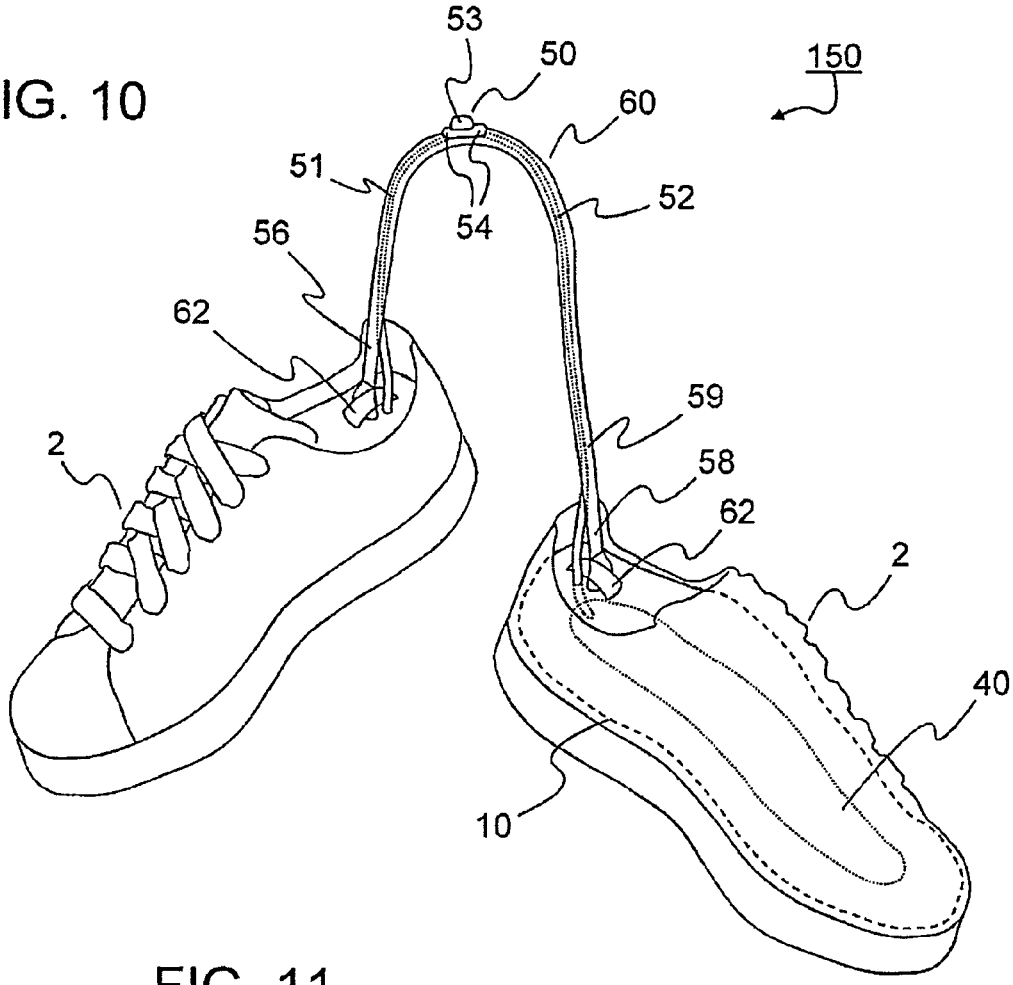
FIG. 10 is a perspective view of an integrated pump system and a flexible strap connected for transport of a pair of preservers in accordance with this invention.
Figure 11:
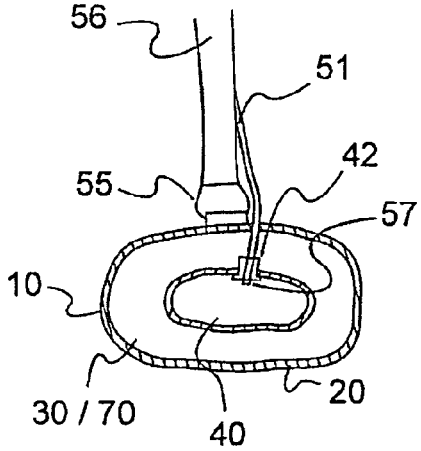
FIG. 11 is side view of a fluid line of the pump system attached to the bladder, and the flexible strap secured to the preserver at an attachment point in accordance with this invention.

FIGS. 10-11 depict the pump 50 as a separate pump system 150. In particular and as shown in FIG. 11, the pump system 150 includes a pump 50 having an inlet 53 and an outlet 54 for receiving, and dispensing air. A pair of fluid lines 51, 52 is shown extending from the pump 50. A first fluid line 51 extends from the outlet 54 of the pump 50 adjacent to a first attachment point 55 at a first distal end 56 in which a first outlet valve 57 is disposed. The first outlet valve 57 is adapted to be received by the inlet valve 42 on the bladder 40.

Likewise, a second fluid line 52 extends from the outlet 54 of the pump 50 to a second attachment point 58 at a second distal end 59 in which a second outlet valve (not shown, but similar in construction and operation to the first fluid 51 previously described in FIG. 11) is disposed. The second outlet valve is also adapted to be received by the inlet valve 42 on the other shoe preserver 10.

FIG. 10 further illustrates an interconnecting flexible strap 60 in which a pair of shoe preservers 10 may be carried. The interconnecting flexible strap 60 includes a first distal end 56 having a first attachment point 55 adapted to engage a loop fastener 62 on the preservers 10. The interconnecting flexible strap 60 also includes a second distal end 59 with a second attachment point 58 adapted to engage the other preserver 10. Although the first attachment point 55 is depicted on a first side of the shoe preserver 10, it is to be understood that the attachment points 55, 58 and the associated loop fasteners 62 may be secured on any side of the shoe preserver 10.

Although depicted as a loop fastener 62, the various attachment points 55, 58 of the interconnecting flexible strap 60 may be implemented for use, including but not limited to integrating: snaps, stitches, hook and loop fasteners, adhesives, and/or any other suitable fastener, now known or later discovered in accordance with this invention.

The interconnecting flexible strap 60 may be constructing from any number of various materials, including but not limited to nylon, cotton, plastic, and/or any other durable material for carrying various loads. Likewise, the interconnecting flexible strap 60 may be constructed to include various snaps, stitching, hook and loop fasteners, adhesives, and the like. The flexible strap 60 may be universal and detachable among the various embodiments of this invention.

In more detail, FIG. 10 illustrates the combination of the interconnecting flexible strap 60 and the pump system 150. As shown, the pump system 150 may be integrated within the interconnecting flexible strap 60. As such, the modified interconnecting flexible strap 60 serves the dual purpose of carrying the shoes 2 including the shoe preservers 10 wedged within the shoes 2, as well as to provide a pumping mechanism to inflate the bladder 40 within the shoe preservers 10.

In use, the bladder 40 is expanded so that the permeable flexible covering 20 can completely fill the interior surface area 4 of the shoe 2. As mentioned before, a pressure force (F) is evenly distributed outward from the bladder 40 throughout the interior surface area 4 of the shoe 2 causing the shoe preserver 10 to be securely wedged into the shoe 2. Consequently, the shoe preserver 10 will be precluded from slipping out of the shoe 2 upon exertion of a sufficient perpendicular force exerted, in the direction of, and along the interconnecting flexible strap 60 during transport of the shoe 2.

As shown in FIG. 11, and in accordance with another aspect of this invention, a deodorant 70 may be disposed within the shoe preserver 10 to impart a pleasant odor to the shoe 2. The deodorant 70 may also be disposed within the permeable flexible covering 20 in order to deodorize the shoe 2 as the absorbing material 30 operates to withdraw moisture from the interior surface area 4 of the shoe 2.

The deodorant 70 may integrated in a variety of different forms, including but not limited to for example, a gel, a powder, cedar chips, a fluid deodorant and/or any other deodorant, now known or later discovered, in accordance with this invention.

Although the preservers 10 are previously described with respect to shoes, it is to be understood that a variety of different embodiments are possible. For example, this invention may be used in combination with any type of protective covering, including but not limited to, a boot, a glove, and/or a hat.

FIG. 12, by way of example, illustrates the use of a pair of boot preservers 100 used in combination with a pair of boots 12. In an un-inflated state, the boot preserver 100 resembles the shape of a shriveled sock that can be easily inserted within each of the boots 12. As shown in FIG. 13 in an inflated state, the boot preservers 100 include a permeable flexible covering 20, an absorbing material 30, a bladder 40, a pump 50, and an interconnecting flexible strap 60. The various components that make up the boot preservers 100 include all of the features and functionality of the other preservers 10, 200, 300 described herein.

In use, the pump 50 is integrated as a part of the inlet valve 42 of the bladder 40. As shown, the bladder 40 may be inflated by repeatedly compressing a resilient bulb 68 in the pump 50 until the permeable flexible covering 20 completely fills the interior surface area 4 of the boot 12.

A flexible strap 60 may be attached to the various boot preservers 100 which will make holding and finding the pair of boots 12 easy. The flexible strap 60 may be modified to carry other accessories commonly used when wearing a pair of boots, such as a gloves, a jacket, a scarf, ear muffs, a hat and the like.

As shown in more detail in FIG. 10, a first distal end 55 of the flexible strap 60 includes a first attachment point 56 adapted to engage the boot preserver 100. Likewise, a second distal end 59 of the flexible strap 60 includes a second attachment point 58 adapted to engage the boot preserver 100.

FIG. 13 illustrates the use of a glove preserver 200 used in combination with a pair of gloves 22. In an un-inflated state, the glove preserver 200 resembles the shape of a shriveled hand that easily fits within each of the gloves 22. As shown in the inflated state, the glove preserver 200 includes a permeable flexible covering 20, an absorbing material 30, a bladder 40, a pump 50, and an interconnecting flexible strap 60. The various components that make up the glove preserver 200 include all of the features and functionality of the other preservers 10, 100, 300 described herein.

In use, the pump 50 is integrated as a part of the inlet valve 42 of the bladder 40. As shown, the bladder 40 may be inflated by repeatedly compressing a resilient bulb 68 in the pump 50 until the permeable flexible covering 20 completely fills the interior surface area 4 of the glove 22.

A flexible strap 60 may be attached to the various glove preservers 200 which will make holding and finding the pair of gloves 22 easy. The flexible strap 60 may be modified to carry other accessories commonly used when using a pair of gloves, such as a jacket, a scarf, ear muffs, a hat and the like.

As shown in more detail in FIG. 10, a first distal end 55 of the flexible strap 60 includes a first attachment point 56 adapted to engage the glove preserver 200. Likewise, a second distal end 59 of the flexible strap 60 includes a second attachment point 58 adapted to engage the glove preserver 200.

Figure 14:
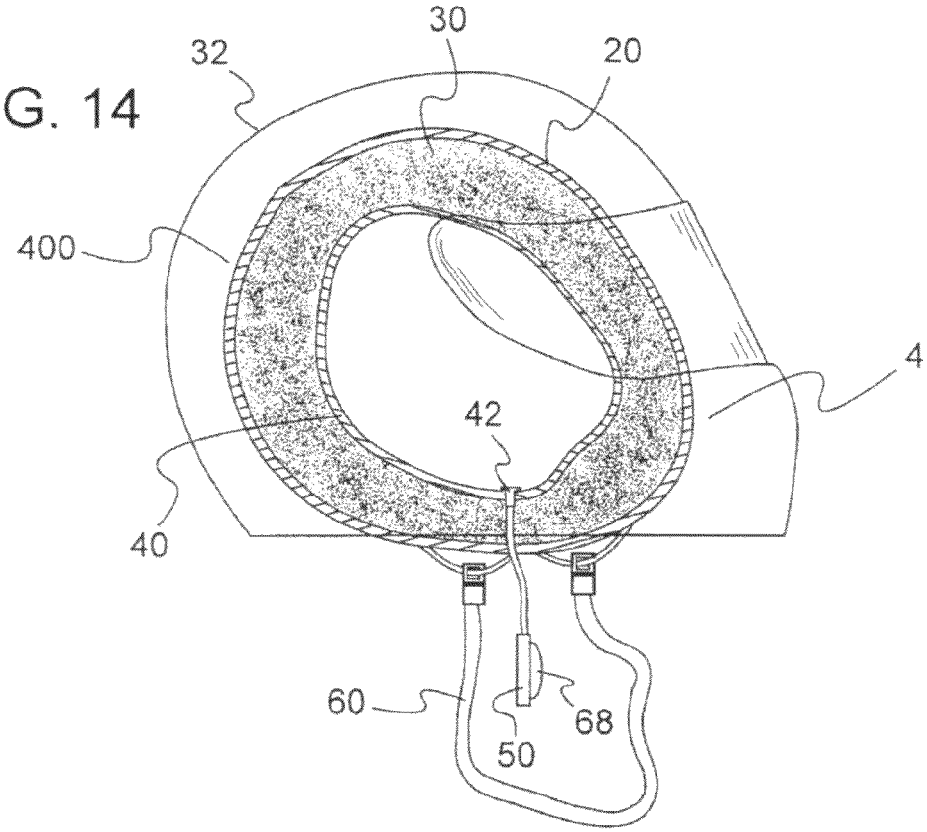
FIG. 14 is a cross-section view of a preserver and the flexible strap adapted for use with a helmet in accordance with this invention.
Figure 15:
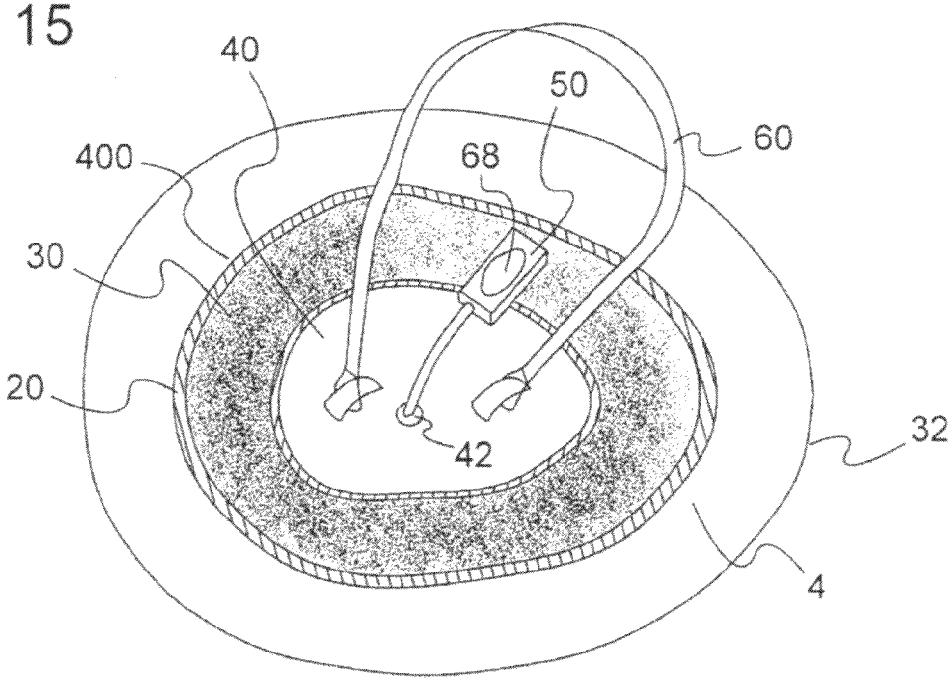
FIG. 15 is a bottom cross-section view of the preserver and the flexible strap adapted for use with the helmet in accordance with this invention.

FIGS. 14-15 illustrate the use of a helmet preserver 300 used in combination with a helmet 32. In an un-inflated state, the helmet preserver 300 resembles the shape of a shriveled ball suitable to be easily inserted within the helmet 32. As shown in an inflated state, the helmet preserver 300 includes a permeable flexible covering 20, an absorbing material 30, a bladder 40, a pump 50, and an interconnecting flexible strap 60. The various components that make up the helmet preserver 300 include all of the features and functionality of the other preservers 10, 100, 200 described above.

In use, the pump 50 is integrated as a part of the inlet valve 42 of the bladder 40. As shown, the bladder 40 may be inflated by repeatedly compressing a resilient bulb 68 in the pump 50 until the permeable flexible covering 20 completely fills the interior surface area 4 of the helmet 32.

A flexible strap 60 is attached to the helmet preserver 300 that can be easily gripped to carry the helmet 32. The flexible strap 60 may also be modified to carry other accessories, such as gloves, a jacket, riding pants and the like.

As shown in more detail in FIG. 10, a first distal end 55 of the flexible strap 60 includes a first attachment point 56 adapted to engage the helmet preserver 300. Likewise, a second distal end 59 of the flexible strap 60 includes a second attachment point 58 adapted to engage the helmet preserver 300.

An aspect of this invention is to create a modular preserver system in which the various components of this invention may be separably replaced. That is, any portion of the preserver 10, the permeable flexible covering 20, the permeable flexible liner 34 and absorbent, the bladder 40 and associates pump system 50, the flexible strap 60, the compact housing 80, the compact cover 82, the stirrup 94, and/or any of the other components in the embodiments described herein and/or modifications and additions within the scope of this invention may be interchangeable and separably replaced.

Figure 17:
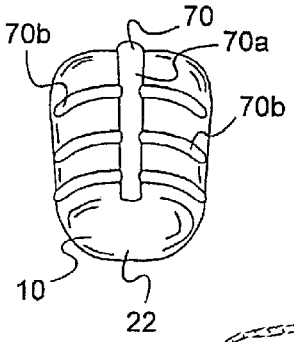
FIGS. 16 and 17 illustrate the use of a rigid liner in accordance with the modular preserver system of this invention.
Figure 16:
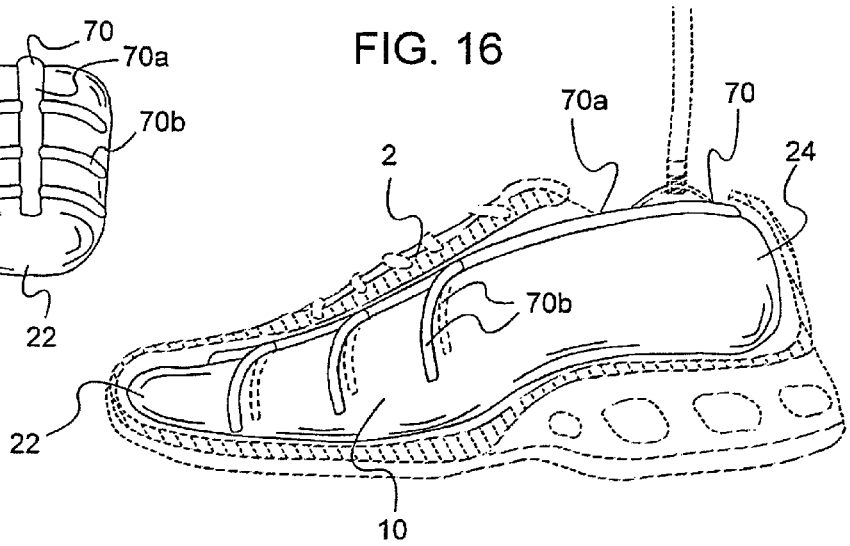

FIGS. 16 and 17 depict the use of a rigid liner 70 to provide a frame to the form of the preserver 10 in accordance with the modular preserver system of this invention. The advantage of integrating a rigid liner 70 is to provide rigidity to the preserver 10 is so that when the preserver 10 is pushed toe first into the shoe 2, the toe end 22 of the preserver 10 will easily slide into the shoe 2 without being folded or disoriented, which would make installation of the preserver within the shoe 2 more difficult. The pattern of the rigid liner 70 may mimic the pattern of a foot, and/or the like. It is within the scope of this invention to utilize a more rigid material for constructing the permeable flexible covering 20. As such, a suitable rigid material will also make installation of the preserver 10 easier into the shoe 2.

FIGS. 16 and 17 illustrate an exemplary embodiment for the rigid liner 70. As shown, the rigid liner 70 includes a first rigid backbone 70*a* which, as shown, extends along the top surface of the preserver 10 from the toe end 22 to the heel end 24. Disposed between the toe end 22 and the heel end 24 of the preserver 10 are various rigid members 70*b* which laterally extend from the rigid backbone 70*a* outward along the contour of the preserver 10 to provide a sufficiently rigid frame. Although the various rigid members 70*b* are shown on the upper side of the preserver 10, it is understood that the rigid members 70*b* may extend completely around the preserver 10 and may be joined at the rigid backbone 70*a*. Since use of the preserver 10 is interchangeable, either side of the preserver 10 may be used as the top and the bottom and vice-versa. Accordingly, the rigid backbone 70*a* members and/or rigid members 70*b* may be disposed on what would appear as an underside of the preserver 10. Likewise, one or more rigid backbone 70*a* members and/or rigid members 70*b* may be integrated with this embodiment. It is further understood that any type of suitable rigid member system may be integrated onto the preserver 10.

Figure 18:
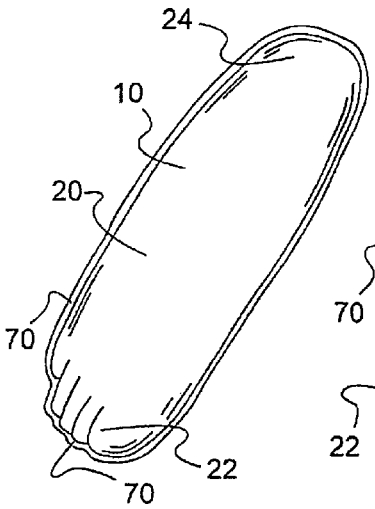
FIGS. 18 and 19 illustrate another exemplary embodiment for providing a rigid liner on the preserver in accordance with this invention.
Figure 19:
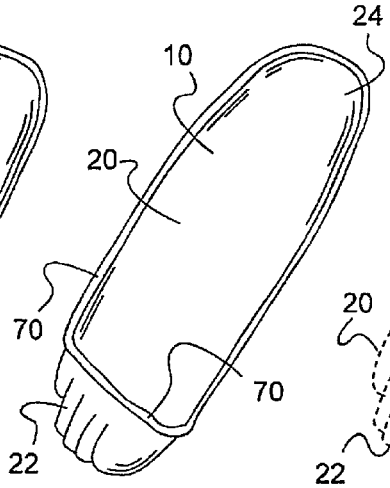

FIGS. 18 and 19 illustrate another exemplary embodiment for providing a rigid liner 70 on the permeable flexible covering 20 of the preserver 10. That is the rigid liner 70 extends approximately around a circumference of the permeable covering forming a frame which substantially covers the toe end 22 and the heel end 24 of the permeable flexible covering 20. It is to be understood that the term "rigid" used in the rigid liner 70 is one in which the rigidity of the liner is substantially rigid and may be flexibly expanded and/or manipulated into various shapes to account for the normal expansion, contraction and bending of the preserver 10 in use. For example, where the bladder is used above, the rigid liner 70 has the capacity to expand and contract as necessary.

A first exemplary showing of the rigid liner 70 frame depicts the use of the rigid liner 70 being extended around a circumference of the preserver 10 forming a frame which covers both the toe end 22 and the heel end 24 of the preserver 10.

FIG. 19 shows another exemplary embodiment in which the rigid liner 70 is disposed approximately around a portion of the circumference of the permeable flexible covering 20 of the preserver 10. That is, the rigid liner 70 encircles the heel end 24, and only a portion of the toe end 22 of the preserver 10. This configuration allows entry of the preserver 10 to be effortlessly aligned within the opening of the shoe 2. As mentioned above, any type of suitable rigid member system may be integrated onto and/or as part of the preserver 10.

Figure 20:
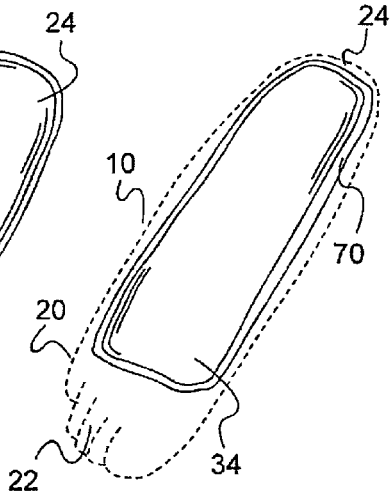
FIG. 20 shows even another exemplary embodiment for a rigid liner in disposed around a permeable flexible liner in accordance with this invention.

FIG. 20 shows another exemplary configuration for the rigid liner 70. In FIG. 20, the rigid liner 70 is integrated as part of the permeable flexible liner 34 which is disposed within the permeable flexible covering 20 of the preserver 10. The permeable flexible liner 34 is shown disposed within the permeable flexible covering 20 of the preserver 10. The rigid liner 70 is depicted as integrated onto the permeable flexible liner 34. In use, the rigid liner 70 of the permeable flexible liner 34 provides the rigid strength necessary to easily push the preserver 10 into the shoe 2.

The rigid liner 70 may be constructed in a variety of different ways. The rigid liner 70 may be configured so that it is expandable. The rigid liner 70 may be constructed so that it may be expanded up to a predetermined shape to fit within a predetermined size of a shoe 2. The rigid liner 70 may be constructed from, but not limited to, a metal, a polymer, rubber, an elastic material, a fabric, a stitching which gathers and builds-up of firm material ridge, and/or any other suitable material capable of providing rigid support to the preserver 10. The rigid liner 70 may be formed in various configurations, such as a ribbing, a stitching, a tubing, a layering of a material, any combination thereof and/or any other suitable mode for providing a frame.

Figure 21:
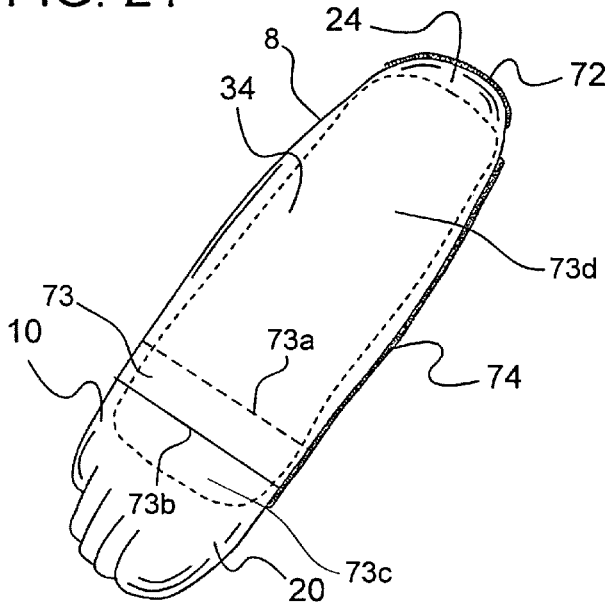
FIG. 21 illustrates yet another exemplary embodiment for the permeable flexible covering of the preserver in accordance with this invention.

FIG. 21 shows various exemplary constructions for the permeable flexible liner 34, and the permeable flexible covering 20 of the preserver 10. The permeable flexible covering 20 illustrates the implementation of various openings 72, 73*a*, 73*b* and 74. An opening 72 is shown disposed in the heel end 24 of the permeable flexible covering 20 adapted to receive the permeable flexible liner 34.

Alternatively, the permeable flexible liner 34 may be inserted through a second opening 74 as shown on a side of the permeable flexible covering 20. Although the permeable flexible covering 20 in FIG. 21 is shown to resemble the shape of a foot, it is within the scope of this invention construct the permeable flexible covering 20 to resemble a more generic cylindrical-like shape. The foot like shape of the permeable flexible covering 20 and permeable flexible liner 34 having wide sections at the toe end 22 and the foot end 24 of the permeable flexible covering 20, and a narrow portion disposed in between, will be described in more detail with respect to FIGS. 42-49.

In such a construction, the side opening 74 allows insertion of the permeable flexible liner 34 into the permeable flexible cover 20 easier that having to try and force the permeable flexible liner 34 into the permeable flexible covering 20 from the heel end 24 through the narrow midsection and on through to the toe end 22.

In another construction, a top opening may be formed like a duvet opening 73. That is, a first inner opening flap 73*a* is overlapped by a second outer opening flap 73*b*. The first inner opening flap 73*a* may be formed of a first portion 73*c* stitched 8 into the edges of the permeable flexible covering 20 to form the first inner opening flap 73*a*. The second outer opening flap 73*b* may be formed of a second portion 73*d* stitched 8 into the edges of the permeable flexible covering 20 to form the second outer opening flap 73*b*. The permeable flexible liner 34 would be installed within the permeable flexible covering 20 by opening both the overlapped second outer opening flap 73*b* and then the first inner opening flap 73*a* to create an opening to permit the permeable flexible liner 34 to be placed within the interior of the permeable flexible covering 20. Although shown disposed at the top of the permeable flexible covering 20, the duvet opening 73 may be located at any position on the permeable flexible covering 20 to allow access to the permeable flexible liner 34.

The permeable flexible liner 34 may be installed within the permeable flexible covering 20 of the preserver 10 through at least one of the various openings 72, 73*a*, 73*b*, 74. For convenience of understanding, the openings 72, 73*a*, 73*b*, 74 are shown, but only one opening is needed to receive the permeable flexible liner 34. Although these openings 72, 73*a*, 73*b*, 74 are shown, it is to be understood that any number of openings, and positioning for various openings in the permeable flexible covering 20, is possible in accordance with this invention.

Figure 22:
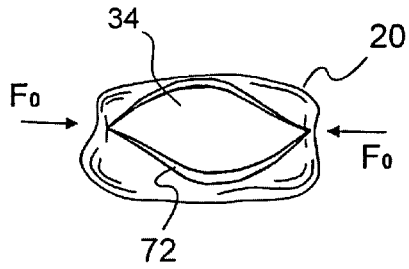
FIGS. 22 through 24 show at least four exemplary illustrations for various openings in the permeable flexible covering in accordance with this invention.
Figure 23:
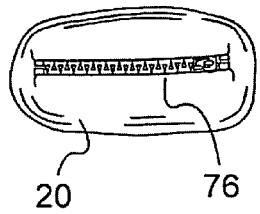
Figure 24:
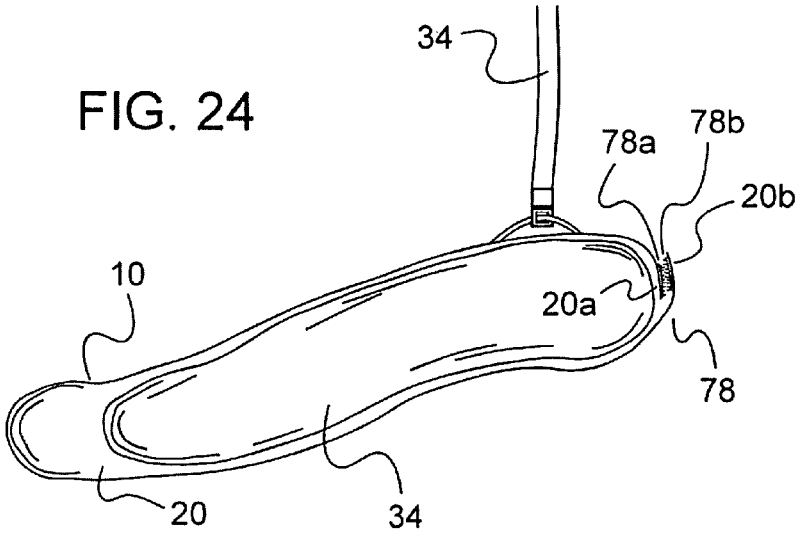

FIGS. 22 through 24 illustrate at least four exemplary constructions for providing various openings 72, 74, 76, 78. FIG. 22 depicts the opening 72 in the heel end 24 of the permeable flexible covering 20 having an open mouth construction adapted to receive the permeable flexible liner 34 therein. The opening 72 may be constructed in a variety of different methods. For example, the opening 72 may be constructed to be biased closed. In order to insert the permeable flexible liner 34 within the opening 72 of the permeable flexible covering 20, the biased closed opening 72 may be overcome by applying an opening force $F_o$ to the mouth of the opening 72 so that the biased closed element may overcome and will be forced open as shown in FIG. 22. The biased element may be a spring integrated into the opening 72.

FIG. 23 depicts an alternative zipper opening 76 disposed in the permeable flexible covering 20. The zipper opening 76 may be provided on any part of the permeable flexible covering 20 to allow ingress and egress of the permeable flexible liner 34 within the permeable flexible covering 20.

FIG. 24 illustrates yet another exemplary securing mechanism. For exemplary purposes, the securing mechanism in FIG. 24 will be described with respect to a Velcro opening 78. As shown, the Velcro opening 78 includes a first securing member 78*a* disposed on a first permeable flexible liner portion 20*a*. A second securing member 78*b* is disposed on a second permeable flexible liner portion 20*b*.

In operation, the first securing member 78*a* and the second securing member 78*b* may be secured together to close the opening 78 in the permeable flexible covering 20. It is to be understood that various types of securing mechanisms may be employed, including but not limited to: Velcro, snaps, a button, a zipper, a sleeve or a pocket, and/or any other type of mechanism capable of securing the permeable flexible covering 20 of the preserver 10 closed.

Figure 25:
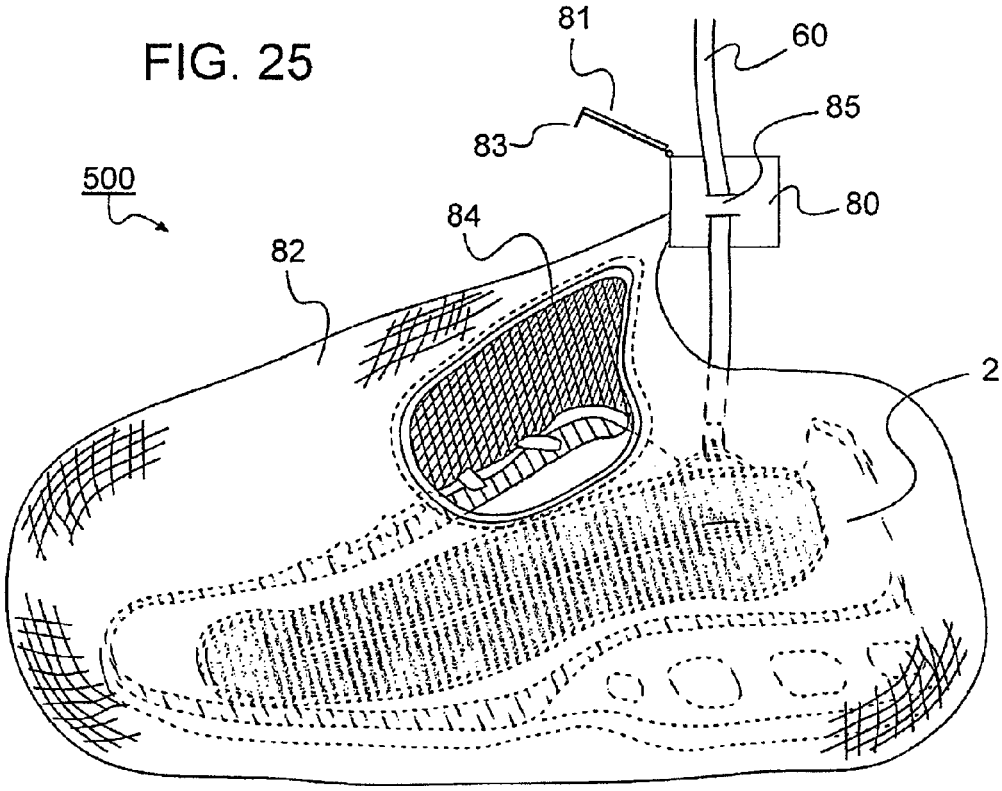
FIG. 25 illustrates a compact housing adjustably connected by a fastener to the flexible strap in accordance with the modular preserver system of this invention.

FIG. 25 illustrates a compact housing 80 adjustably connected by a fastener 85 to the flexible strap 60. As shown, a lid 81 including a latch 83 is open and a compact cover 82, adapted to be stored within the compact housing 80, is shown uncompressed and wrapped around a shoe 2. An aperture 84 may be disposed in the compact cover 82 to allow a user access to the shoe 2 and other components inside of the compact cover 82.

An advantage to integrating the compact housing 80 with a compact cover 82 is to store and provide a protective cover over a dirty or moist shoe 2 from other objects that would normally come into contact with the soiled shoe 2. For example, an avid runner will oftentimes run over mud, feces, water, oil and the like. These contaminants become lodged in the sole of the shoe 2 and remain there for some time causing unsanitary havoc to the surfaces that come into contact with the sole and/or exterior of the soiled shoe 2. When the runner finishes their run, they will typically take their shoes off and place them in a vehicle (such as, on a seat, the floor or in the trunk), in their home on a floor and/or some other the location. Unfortunately, the shoes covered with these filthy contaminants will inevitably spread the collected dirt onto others surfaces the shoes come into contact with. Thus, at least one advantage of integrating the compact cover 82 is to contain the contaminants and/or other pollutants collected by the shoes 2 within the compact cover 82. Likewise, the compact cover 82 protects the surrounding surfaces that would otherwise come into direct contact with the shoes 2. Covering the moist shoe 2 also facilitate directing the moisture toward the preserver 10 disposed within the shoe 2 and promotes a quicker moisture collection and more sanitary drying process of the shoe 2.

Various types of materials may be used to construct the compact cover 82, including but not limited to, a plastic, polymer, a fabric and/or any other suitable material capable of covering the shoe 2. The compact cover 82 may also be constructed of a gas or liquid permeable material to allow proper aeration of the shoe 2. It is to be noted that, although the compact cover 82 is shown attached to the compact housing 80, the compact cover 82 may be separable and completely detached from the compact housing 80.

Figure 26:
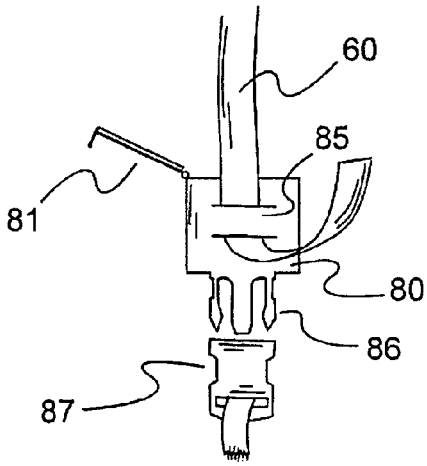
FIG. 26 depicts an alternative construction for the compact housing in accordance with the modular preserver system of this invention.

FIG. 26 depicts an alternative construction for the compact housing 80. As shown, the compact housing 80 includes a fastener 85 portion which secures the flexible strap 60. Various methods for fastening the flexible strap 60 to the fastener 85 may be used which are commonly available. The compact housing 80 also includes a first connector 86 portion suitable for connection with a second connector 87 portion. The second connector portion 87 may be disposed on any number of different components in this modular preserver system 500.

Figure 27:
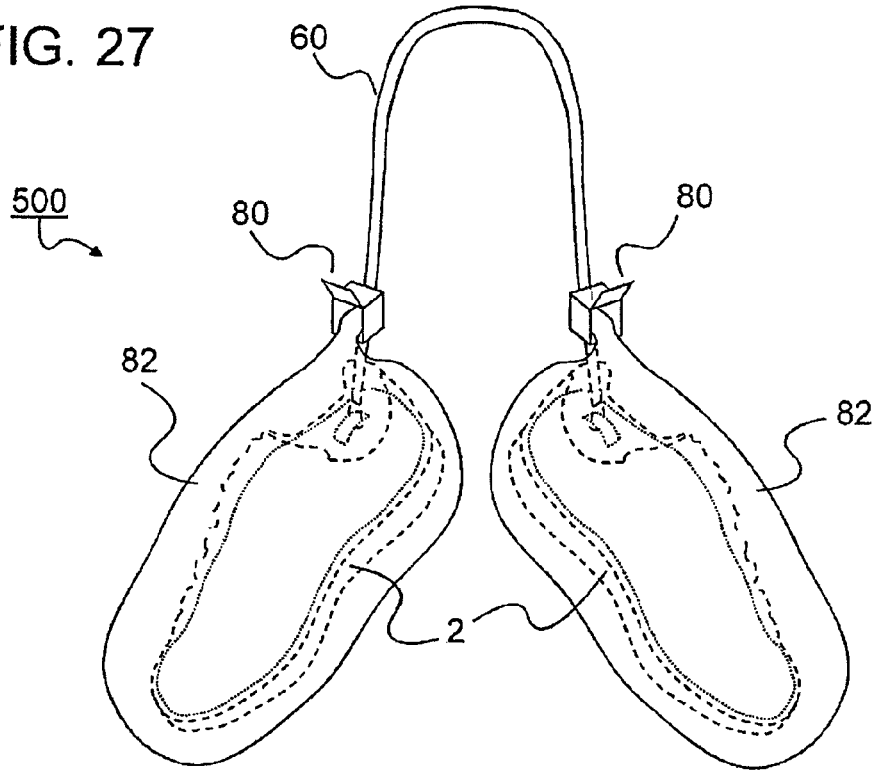
FIG. 27 depicts a pair of compact housing elements from which a pair of compact covers extend and cover a pair of shoes in accordance with the modular preserver system of this invention.

FIG. 27 depicts a pair of compact housing 80 elements from which a pair of compact covers 82 extend and cover a pair of shoes 2 in accordance with the modular preserver system. As shown, a user may easily carry a pair of covered soiled shoes 2 with the flexible strap 60 and would not have to worry about getting themselves dirty while carrying the shoes 2 because the compact covers 82 protect the user from any of the residual contaminant on the shoes 2.

Figure 28:
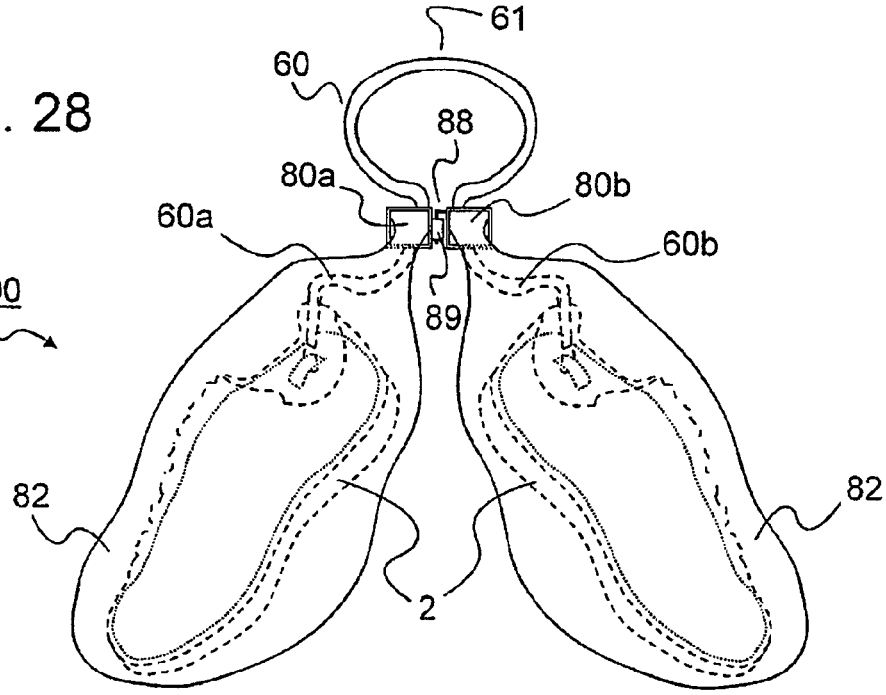
FIG. 28 demonstrates another exemplary use for being able to connect the compact housings to each other in accordance with the modular preserver system of this invention.

FIG. 28 demonstrates another exemplary use in which the compact housings 80 may be compactly connected to each other. In FIG. 28, the first connector 88 and the second connector 89 portion of the pair of compact housings 80*a*, 80*b* shown are illustrated by a hook and latch type securing mechanism.

A user adjust the length of the flexible strap 60 between the pair of shoes 2 housed within the compact covers 82. Each of the compact housings 80*a*, 80*b* may be independently adjusted on the flexible strap 60 as desired. FIG. 28 shows the first and second compact housings 80*a*, 80*b* adjusted so that a handle portion 61 formed by the shortened and closed flexible strap 60 is small enough to comfortably carry the shoes 2. For example, if a user carries the pair of shoes 2 shown in the modular preserver system 500 of FIG. 27 over their shoulder or by carrying the flexible strap 60 by hand, the extended length of the flexible strap 60 will allow the shoes 2 to clumsily sway back and forth from the users hand or shoulder. However, if the user desires to reduce the swaying back and forth by the pair of shoes 2, the user may cinch up the shoes 2 along the flexible strap 60 by adjusting the compact housings 80*a*, 80*b* upward along the flexible strap 60 thereby reducing the pendulum length at which the shoes may sway on the flexible strap 60. As shown in FIG. 28, the flexible strap 60 is shortened by approximately the lengths 60*a* and 60*b*. This excess length may be housed within the compact cover 82. As a result, the modular preserver system 500 configuration shown in FIG. 28 is more compact and may be carried closer to the user's body, thereby minimizing the uncomfortable sway of the shoes 2, and making it easier to transport the shoes 2.

Figure 29:
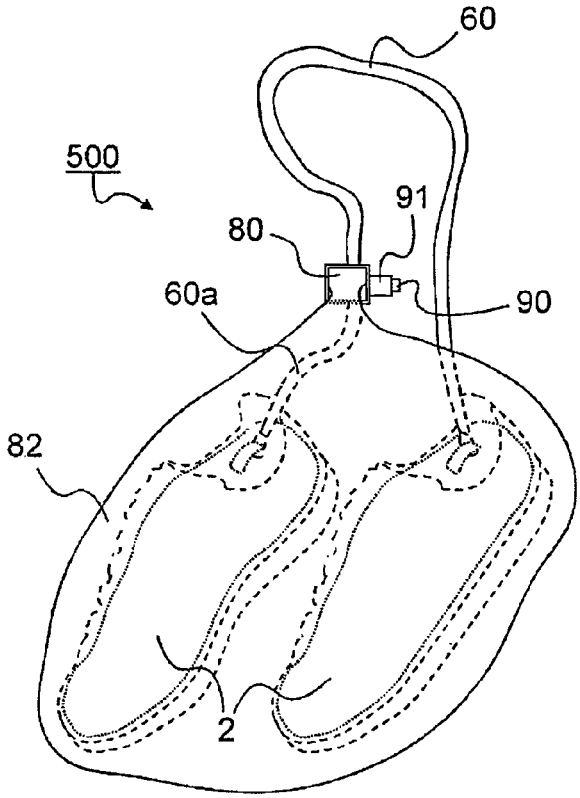
FIGS. 29 and 30 illustrate yet another example for a compact cover in accordance with this invention.
Figure 30:
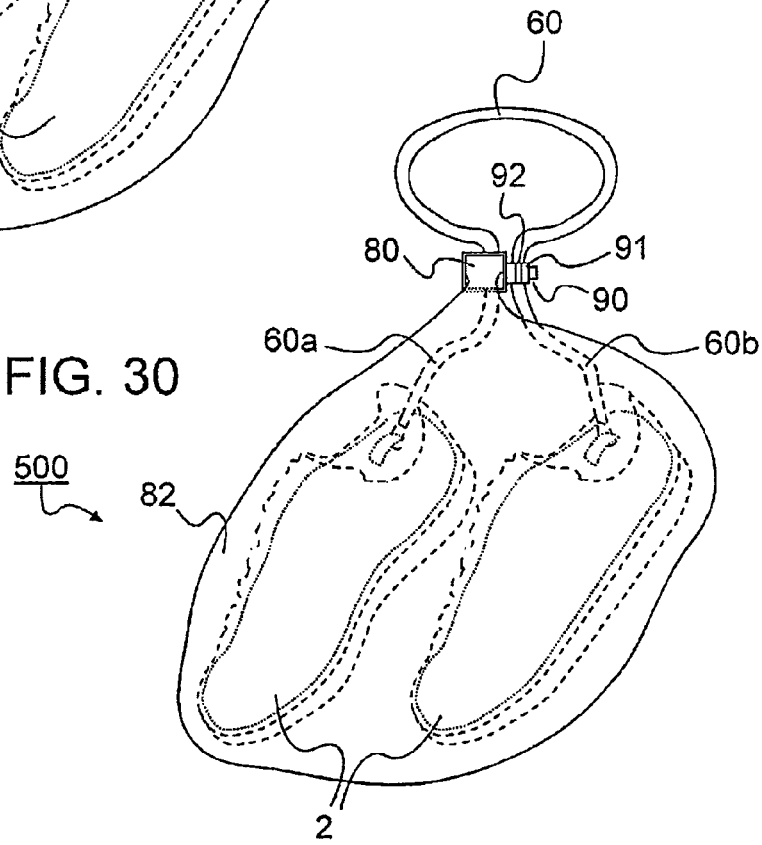

FIGS. 29 and 30 illustrate yet another example for a compact cover 82 in accordance with this modular preserver system 500. In this embodiment, one compact cover 82 is large enough to cover both pairs of shoes 2.

An alternative fastener mechanism is also shown. The fastener mechanism depicted herein is configured as a locking pin 90 and a sleeve housing 91. In FIG. 30, the sleeve housing 91 is adapted to receive the flexible strap 60 within a sleeve 92 of the sleeve housing 91. The flexible strap 60 may be adjusted within the sleeve housing 91 as desired and the locking pin 90 may be engaged to secure the flexible strap 60 within the sleeve housing 91. Similar to the configuration shown in FIG. 28, the pair of shoes 2 may be compactly carried closer to the user's body, thereby minimizing the pendulum-like sway and making it easier to transport the shoes 2.

Although the compact housings 80 and the compact coverings 82 are previously described with respect to shoes, it is to be understood that a variety of different embodiments are possible. This invention may be used in combination with any type of protective covering, including but not limited to, boots, gloves, helmets, hats, and the like.

Figure 31:
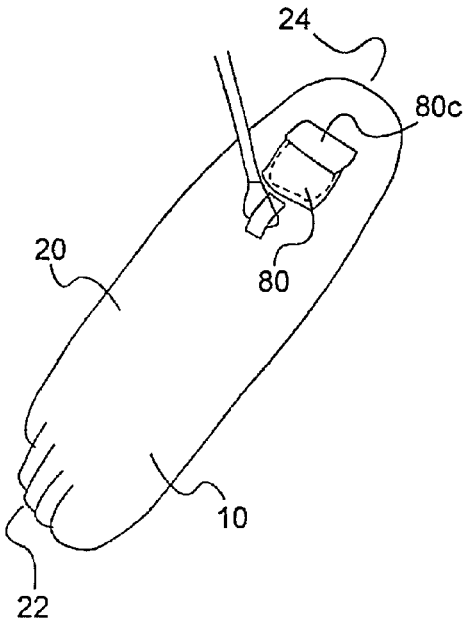
FIGS. 31 and 32 show an alternative exemplary embodiment in which a compact housing is fastened onto a surface of the preserver in accordance with this invention.
Figure 32:
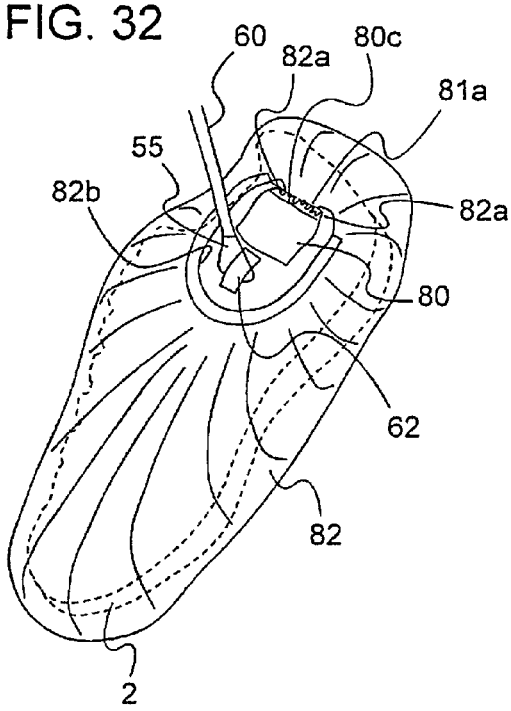

FIGS. 31 and 32 show an alternative exemplary embodiment for the modular preserver system 500 in which a compact housing 80 is fastened onto a surface of the preserver 10. As shown in FIG. 31, the compact housing 80 may include a closure flap 80*c* provided to allow egress and ingress of a compact cover 82.

In FIG. 32, the shoe preserver 10 is installed in a shoe 2 and situated in a position so that the compact housing 80 is accessible when installed in the shoe 2. In use, the closure flap 80*c* of the compact housing 80 may be opened and the compact cover 82 may be pulled out from an opening 81*a* within the compact housing 80 and stretched out over the heel end 24, under the bottom of the shoe 2, back over the toe end 22 of the shoe 2 and over the top of the shoe 2 where the compact cover 82 is brought to rest adjacent to the compact housing 80.

The compact cover 80 is shown attached to the compact housing 80 at fastened points 82*a*. An attachment point 55 on the flexible strap 60 may be connected to a loop fastener 62 disposed on the preserver 10. Placement of the compact housing 80 on the preserver 10 may be located in any suitable location so long as the compact cover 82 may be accessed from within the compact housing 80 when the preserver 10 is installed in the shoe 2.

Figure 33:
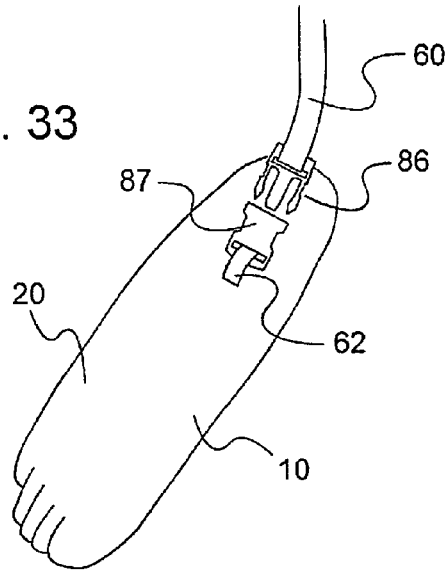
FIG. 33 depicts an alternative design in which the flexible strap and the loop fastener attached to the preserver may be interconnected in accordance with the modular preserver system of this invention.

FIG. 33 depicts an alternative design in which the flexible strap 60 and the loop fastener 62 attached to the preserver 10 may be interconnected. As shown, the flexible strap 60 is connected to a first connector 86 portion. The first connector 86 portion is adapted to mate with a second connector 87 disposed on a surface of the preserver 10. The flexible strap 60 may be adjustably positioned within a fastener on the first connector 86 portion to shorten or lengthen the flexible strap 60 length between the pair of preservers 10 disposed within the pair of shoes 2. It is to be understood that various fasteners commercially available may be used to replace the fastener mechanism shown in the embodiment of FIG. 33.

Figure 34:
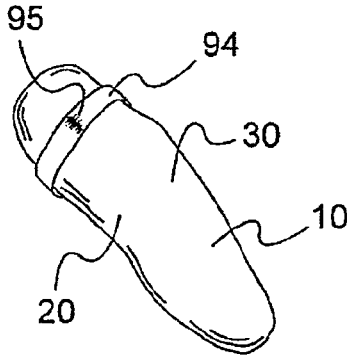
FIGS. 34-36 depict the implementation of a stirrup 94 in accordance with this invention.
Figure 35:
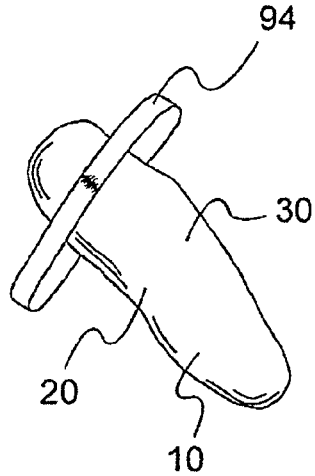
Figure 36:
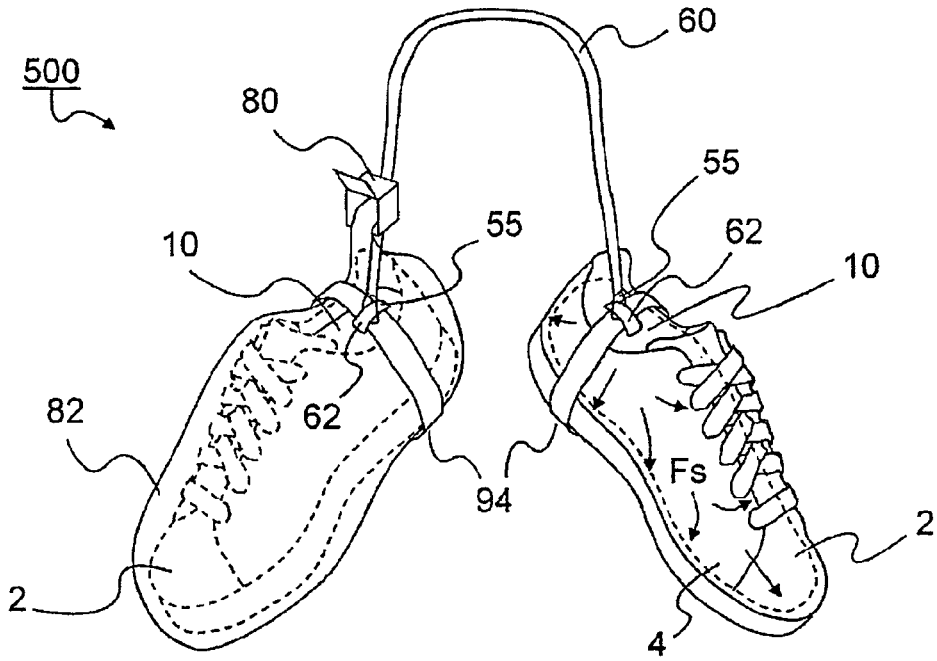

FIGS. 34-36 depict the implementation of an elastic strap disposed about the preserver 10, herein referred to as stirrup 94. The stirrup 94 may be used with any combination of the previously described embodiments. In FIG. 34, the stirrup 94 is shown in a rest position and the stirrup 94 is attached to the preserver 10 at fastener 95. FIG. 35 illustrates the stirrup 94 stretched outward to encircle a shoe 2 and/or other object.

In FIG. 36, the stirrup 94 is wrapped around the compact cover 82, which in turn is wrapped around the preserver 10 disposed within a first shoe 2. On a second shoe 2, the stirrup 94 is wrapped around both, a second shoe 2 and a preserver 10 disposed therein. The advantage of providing the stirrup 94 wrapped around the preserver 10 and the shoe 2 is to ensure that the preserver 10 will not slip out of the shoe 2 in use. The application of the stirrup 94 secures the placement of the preserver 10 with sufficient strength to overcome the exertion of a significantly strong force (such as by the weight of the shoe 2 or a jarring force) directed out of the ankle opening of the shoe 2, which would otherwise cause the shoe preserver 10 to be dislodged from the shoe 2.

Likewise, the stirrup 94 supplies a snug fit between the preserver 10 and the shoe 2. That is, the stirrup 94 applies a distributed pressure force $F_S$ into the preserver 10 and urges the preserver 10 against the interior surface area 4 of the shoe 2. The internal pressure force $F_S$ causes the shoe preserver 10 to be securely wedged into the shoe 2. Forcing the preserver 10 against the interior surface area 4 of the shoes 2 also promotes absorption of the moisture from the shoe 2 into the absorbent material 30 disposed within the preserver 10. Although not shown, it is to be understood that the stirrup 94 may be stretched and wrapped around more than one shoe (e.g., a pair of shoes) at a time.

Figure 37:
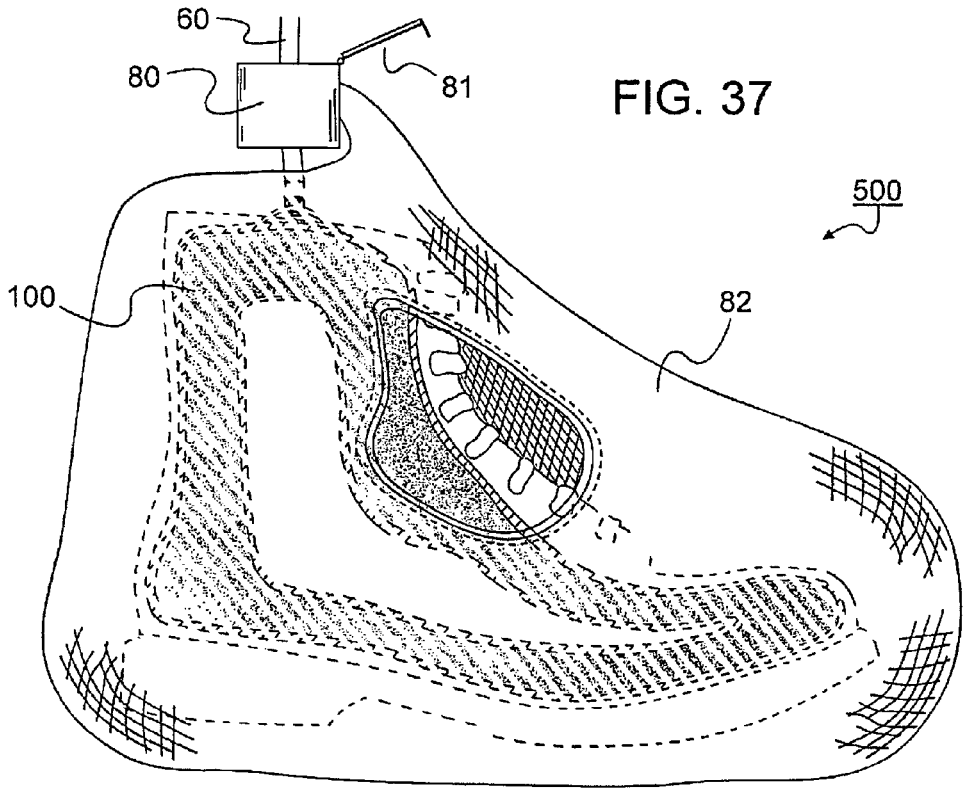
FIGS. 37, 38 and 39 depict various alternative constructions for use with the compact housings and the compact coverings in accordance with this invention.
Figure 38:
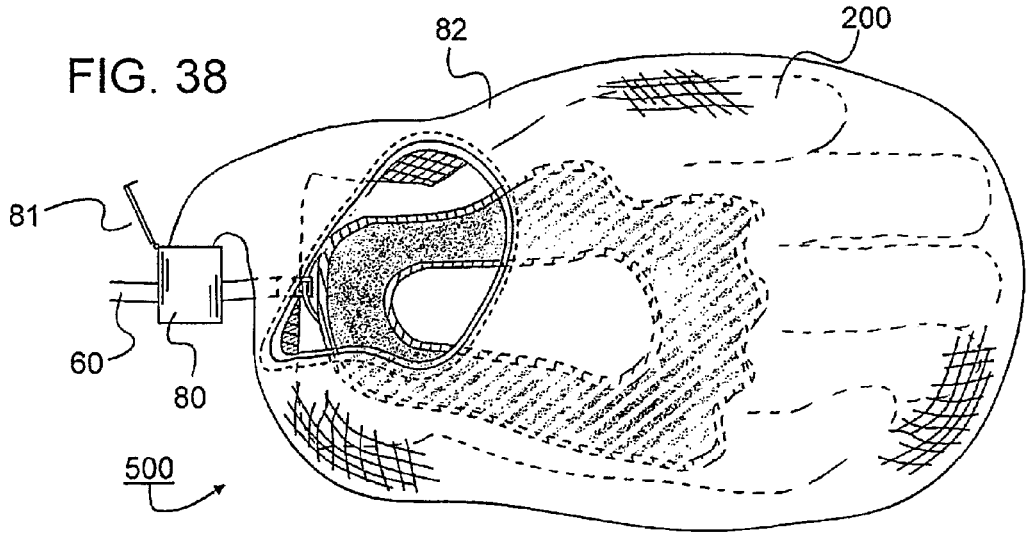
Figure 39:
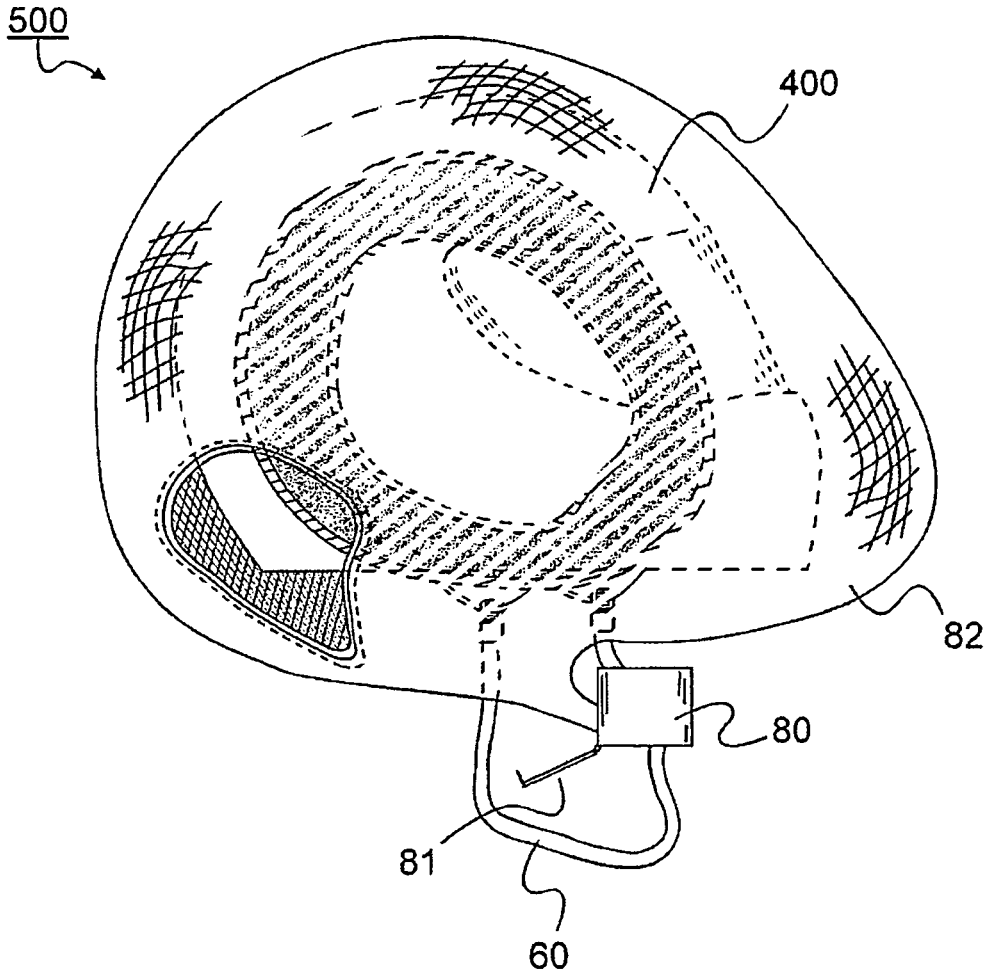

FIGS. 37, 38 and 39 depict various alternative constructions for use with the compact housings 80 and the compact coverings 82. FIG. 37 shows a compact cover 82 extending from a compact housing 80 having a lid 81 adapted for use to cover a boot 100. Likewise, FIGS. 38 and 39 illustrate a compact cover 82 extending from a compact housing 80 having a lid 81, and adapted for use to cover a glove 200 and a helmet 400, respectively. The compact housings 80 and the compact coverings 82 shown in FIGS. 37-39 may include all of the features and functionality of the other embodiments described above with respect to FIGS. 25-36.

Figure 40:
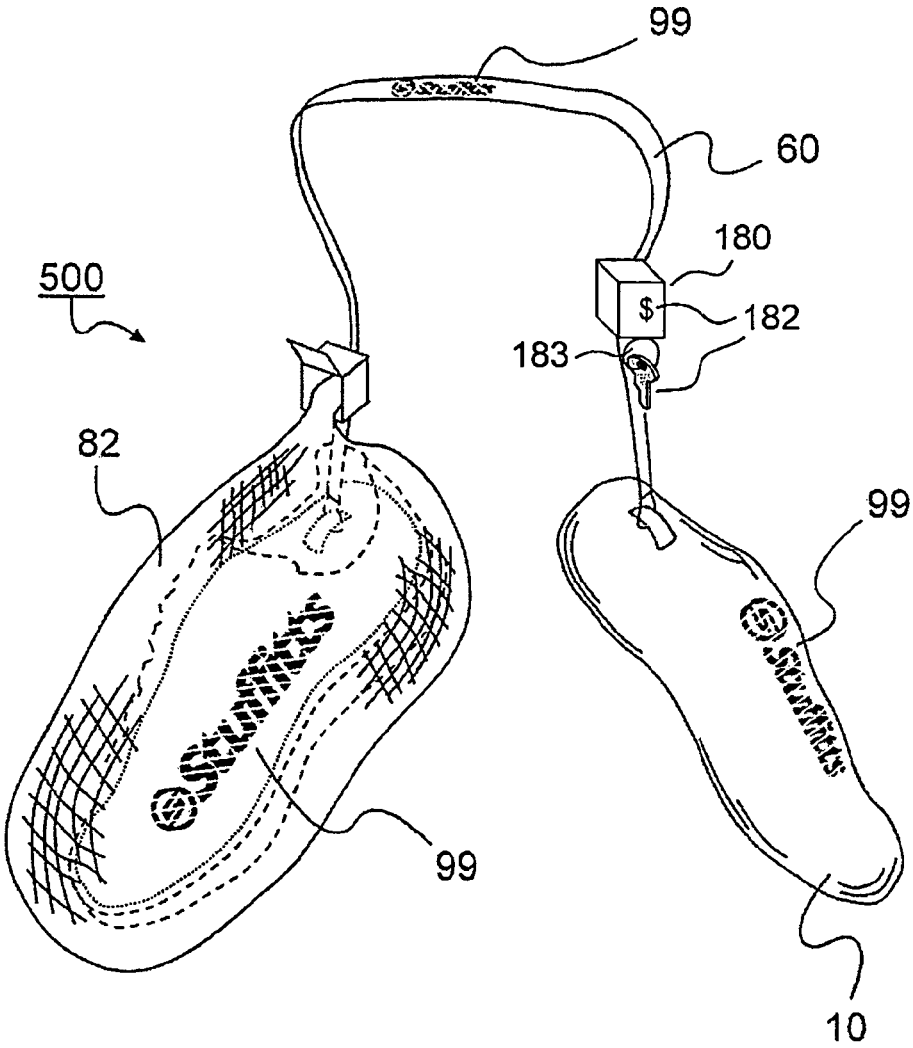
FIGS. 40-41 illustrate the use of indicia in accordance with the modular preserver system of this invention.
Figure 41:
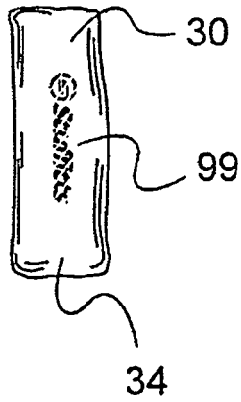

FIGS. 40-41 depict the use of and process of incorporating marking indicia 99 on various components of the modular preserver system 500 in accordance with this invention. The indicia may be any type of indicia, include, but not limited to trademarks, promotional and product identifying indicia, and the like. The indicia may be provided to facilitate the sale of a component of the modular preserver system 500 by any identifiable person or entity in the stream of commerce of the modular preserver system 500, such as but not limited to, a supplier of products, a distributor, a third party involved in preparing the product, a potential consumer to which the modular preserver system 500 is to be sold. The indicia may be associated with the component of the modular preserver system 500. Likewise, collateral materials marked with indicia may also be provided within the scope of this modular preserver system 500 invention.

As shown, indicia 99 may be provided on: the flexible strap 60, the compact cover 82, the preserver 10, and/or any other component in accordance with this modular preserver system 500.

The indicia 99 disposed on the various components of the modular preserver system 500 may be composed of a variety of different shapes, colors and sizes. The indicia 99 may take any desired shape, including but not limited to, circles, rectangles, squares, triangles, designs, a logo, a brand, a mascot, and/or any obtuse shape, design or other printed indicia and the like. The indicia 99 may include, for example, a trademark, a service mark, a name, an emblem, a logo, a banner, an advertisement, a business, the military, a university, a mascot, ribbons, flowers, a sport, a school, a local establishment, a character, hobby and/or any other type indicia of interest.

The indicia 99 may printed on the various components of the modular preserver system 500 in any number of plausible ways, such as for example, but not limited to silk screening and/or any other printing process now known or later developed.

FIG. 40 further illustrates another exemplary use for the compact housing 180. The compact housing 180 may be adapted to conveniently and portably carry various items 182, such as but not limited to money, keys, and the like. By way of illustration, the compact housing 180 depicts money ($) being stored within the compact housing 180. Likewise, a fastening mechanism, such as a hook 183 is shown attached to the compact housing 182 capable of carrying a key, or the like. The compact housing 182 may serve a variety of uses capable of carrying and storing various objects in a compact and secure manner in accordance with this invention.

Referring back to FIG. 41, the permeable flexible covering 20 may be produced in various sizes and shapes to accommodate varying shoe sizes. Similar to the design of the permeable flexible covering 20 shown in FIG. 3, the design of the permeable flexible covering 20 is depicted as being self-contained. Thus, it is within the scope of this modular preserver system 500 to produce the permeable flexible covering 20 separable from the various other components of the preserver 10. For example, the permeable flexible liner 34 and absorbent may be interchangeable and may be replaced by various sizes and shaped permeable flexible liners 34 to accommodate the varying shoe sizes.

The absorbent material in the permeable flexible liner 34 may also be selectively replaced with different types, and/or new absorbents when the previous absorbent properties may need replacing. The amount of absorbent material may be selected based a variety of different factors, including but not limited to, size of the shoe the absorbent is to be inserted into, the weight of the absorbent material, and the like.

Various deodorants, disinfectants, and/or other suitable materials may also be integrated with the preserver. By way of example, a deodorant may be integrated into the permeable flexible liner 34 so that various scents may be selected and combined with the preserver 10 to refresh the shoe 2 and/or other protective covering. Other suitable materials may be used in combination with the permeable flexible liner 34, such as an anti-bacterial, microbial, fungi reducing agent, a disinfectant, and the like.

The permeable flexible covering 20 may also be designed to be interchangeable. The permeable flexible covering 20 is versatile in that any side of the permeable flexible covering 20 may be used as the lower or top portion, and visa-versa. When replacement of the permeable flexible covering 20 (and/or other component) may be required due to wear and tear, only that component may be replaced, and the remainder of the components may be preserved and reused in accordance with this modular preserver system 500.

By separably encasing the absorbent 30 within the permeable flexible liner 34, dust and debris from the absorbent 30 may be more effectively used since the contents within the permeable flexible liner 34 cannot escape. The permeable flexible liner 34 may be designed of a porous material to allow moisture to be absorbed within the permeable flexible liner 34. Likewise, the porous material of the permeable flexible liner 34 may allow for a deodorant included within the permeable flexible liner 34 to permeate across the permeable flexible liner 34 into the shoe 2. In use, the absorbent and deodorant material within the permeable flexible liner 34 will not be able to escape from within the permeable flexible liner 34. The permeable flexible liner 34 may be constructed of varying porosity to efficiently manage the enclosed material.

Figure 42:
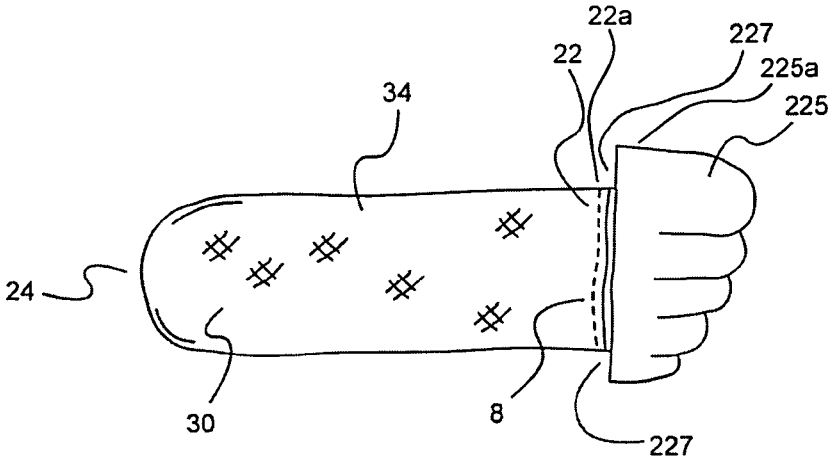
FIG. 42 illustrates an exemplary illustration of a permeable flexible liner.

FIG. 42 illustrates yet another aspect of the modular preserver system in which the various components of the preserver 10 may be separable manufactured and replaced. Any of the components, such as the permeable flexible covering 20, the permeable flexible liner permeable flexible liner 34 including the absorbing material 30, the toe portion 225, the bladder 40 and/or any other part of the preserver 10 may be separably replaced in accordance with this invention.

The advantage of the modular preserver system is to be able to extend the life of the preserve by caring for the various components of the system and being able to reuse them individually. Since the absorbing material 30 in the permeable flexible liner 34 is a self contained unit, the various components of the modular preserver system can be disassembled, separately washed and/or cleaned in order to increase the life expectancy and efficiency of the various individual components of the modular preserver system in accordance with this invention.

Conventional preservers are constructed as a single inseparable unit, and there is no ability to clean the preserver and/or reuse any portion of a conventional preserver. As commonly understood, the absorbing material within a preserver has a predefined life span before its moisture absorbing properties deplete and become useless. Unfortunately, with conventional preservers once the absorbing material properties in the preserver was used, the entire preserver unit was destroyed and the entire unit had to be thrown away. At least in part, this is because it is not possible to separate the absorbing material in a conventional inseparable preserver unit. Consequently, there is no modular process for separating the conventional preserver and/or wash the conventional preserver in a washer and/or other cleaning device. Any attempt to do so would destroy the absorbing material within the conventional preserver. The modular preserver system of this invention overcomes these disadvantages.

For example, in FIG. 42, the absorbing material 30 disposed within the permeable flexible liner 34 may be constructed as a separable element from the toe portion 225 and the remainder of the preserver 10. The absorbing material 30 may be filled within the permeable flexible liner 34 and stitches 8 may be applied to the toe end 22 to close the permeable flexible liner 34. As with any human foot, the heel end 24 of the foot is generally narrower than the toe end 22 of the foot. The entire length of the permeable flexible liner 34 is constructed substantially the same width from the heel end 24 to the toe end 22. The toe end of the permeable flexible liner 34 is positioned and/or may be secured to the toe portion 225 of the permeable flexible liner 34. The toe portion 255 may be constructed from a variety of different materials, including but not limited to, foam, cotton, and/or any other fabric capable of absorbing moisture and/or wicking material.

In an attempt to mimic the contour of a human foot, it is further with thin the scope of this invention to shape the contour of the permeable flexible liner 34 to more closely resemble an actual human foot. By way of example, in FIG. 42, the edge 22*a* of the toe end 22 of the permeable flexible liner 34 does not smoothly merge with the edge 225*a* of the toe portion 225. Instead a gap 227 is present between the edge 225*a* of the toe portion 225 and the edge 22*a* of the toe end toe end 22 of the permeable flexible liner 34. As a result, when the permeable flexible liner 34 and the toe portion 225 are assembled adjacent to each other within a permeable flexible covering 20, the gaps 227 may prevent the permeable flexible liner 34 and the toe portion 225 from maximizing the absorption of the moisture from the shoe 2 into which the moisture is to be collected.

FIGS. 43-49 illustrate an exemplary modification to the construction shown in FIG. 42. In FIGS. 43-49, the construction of the permeable flexible liner 34 of the preserver 10 may be configured to better resemble the anatomical contour of a user's foot. As with a normal foot, the heel end 24 of the foot is smoothly contoured narrower than the toe end 22 of the foot.

Figure 43:
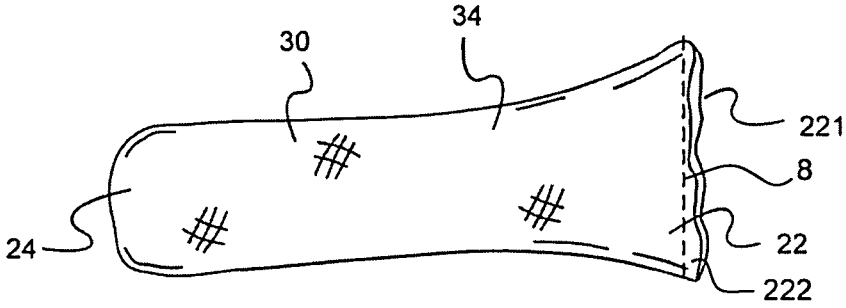
FIGS. 43-45 illustrate a contoured permeable flexible liner adapted to maximize the absorption area within the shoe.
Figure 44:
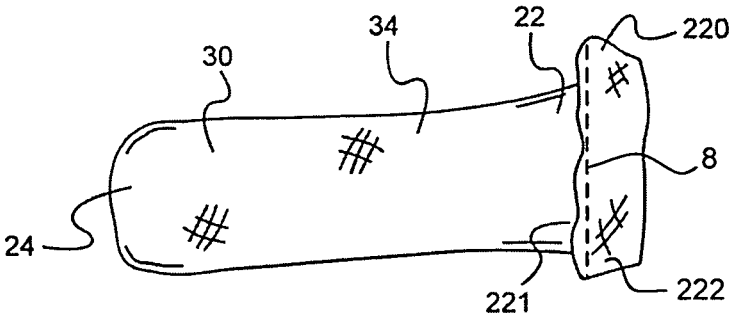

FIGS. 43-44 illustrate a contoured permeable flexible liner 34 adapted to maximize the absorption area within the shoe 2. That is, the permeable flexible liner 34 and the toe portion 225 are contoured as a combined pair that reduces the gaps 227 (as shown in FIG. 42) between the toe edge 22*a* of the toe end of the permeable flexible liner 34 and the edge 225*a* of the toe portion 225 to maximize the absorption material contact within the shoe 2 by maximizing the contact with the interior surface area 4 of the shoe 2 in order to draw in and collect as much of the moisture possible. By reducing the gaps 227, and maximizing the surface area of the permeable flexible covering 20 coming into contact within the interior surface area 4 of shoe 2, superior absorption of the moisture within the shoe 2 is achieved.

As shown in FIGS. 43-46, the contoured foot construction for the exemplary permeable flexible liner 34 maximizes the contact surface area of the absorbing materials within the permeable flexible liner 34 and the toe end 225 of the permeable flexible covering 20 within the interior surface area 4 of the shoe 2. A maximum amount of moisture is absorbed from the shoe 2 and/or other coverings from which moisture is to be absorbed because the permeable flexible covering 20 will come into contact with all of the interior surface areas 4 of the shoe 2 and/or other coverings (as shown in FIGS. 12-15).

Figure 45:
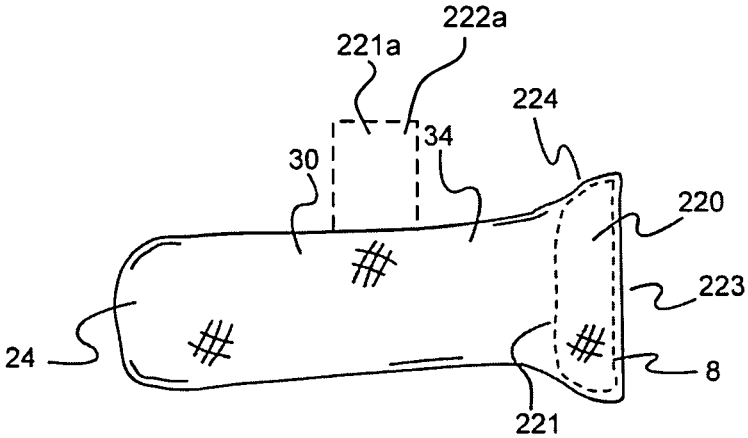
Figure 47:
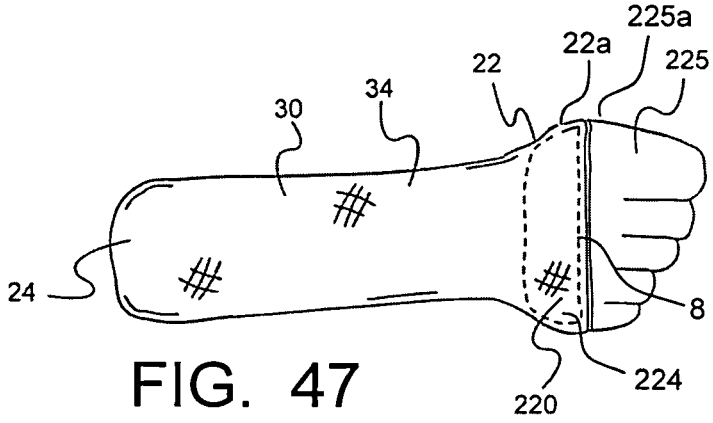
FIGS. 47-49 depict an exemplary showing of the contoured permeable flexible liner disposed within the permeable flexible covering.
Figure 48:
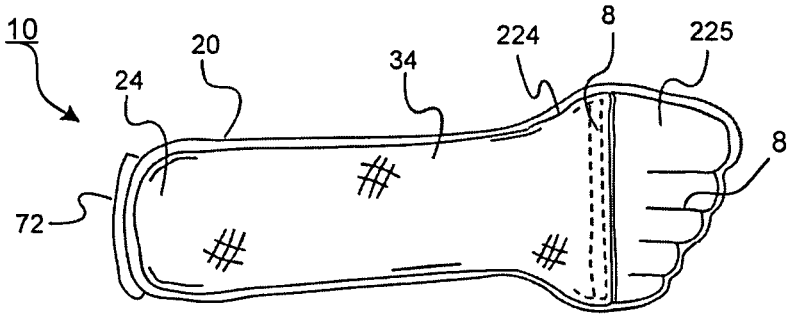

In brief, and as shown in FIGS. 45 and 47-48, the toe end 22 of the 34 is uniquely constructed to have a larger mass of material 224 than the heel end 24 portion of the permeable flexible liner 34. Referring to FIGS. 47-48, the larger mass of material 224 enables the edge 22*a* of the toe end 22 of the permeable flexible liner 34 to substantially align better with the edge 225*a* of the toe portion 225 so as to eliminate any gaps 227 (such as those shown in FIG. 42).

Referring to an exemplary contoured construction shown in FIGS. 43-45, the permeable flexible liner 34 includes having a first heel end 24 closed and narrower than the outwardly widened open toe end 22 of the permeable flexible liner 34. The outwardly widened toe end 22 of the permeable flexible liner 34 has an opening 221 disposed in an extended material flap 222 that is adapted to receive the absorbing material 30 within the permeable flexible liner 34.

Figure 46:
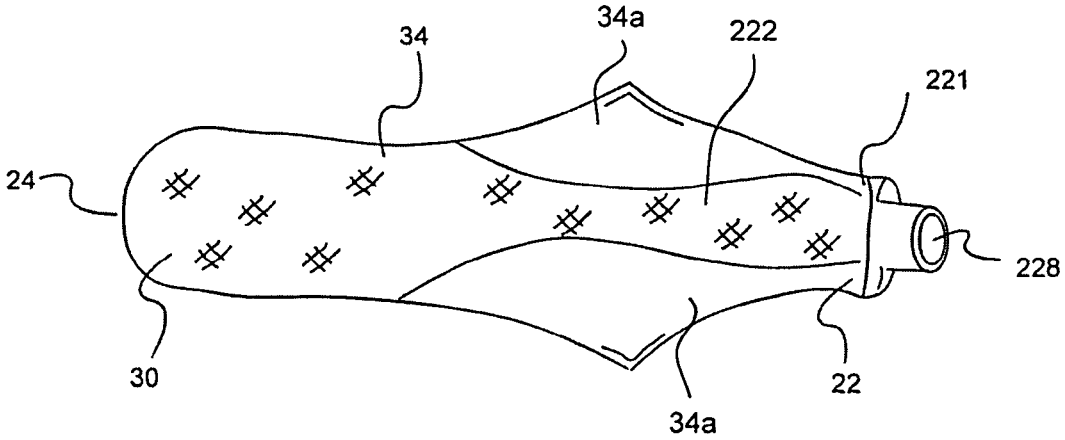
FIG. 46 shows construction of a contoured permeable flexible liner being filled by an absorbing material.

FIG. 46 depicts another exemplary construction for the permeable flexible liner 34 having an extended material flap 222 that extends outward to define a pair of spread winged portion 34*a* which, when the extended material flap 222 is folded, as will be described later, will also produce the built up mass of material 224 contoured construction for the toe end 22 of the permeable flexible liner 34. As shown in FIG. 46, during construction of the contoured permeable flexible liner 34, a predetermined quantity of the absorbing material 30 may be filled through a spout 228, or the like, into the open toe end 22 of the permeable flexible liner 34.

The permeable flexible liner 34 may take a variety of different shapes, however, the principle features and advantages of the unique humane appendage contoured construction for the permeable flexible liner 34 are similar. Once the desired amount of the absorbing material 30 has been filled into the opening 221 of the toe end 22 of the permeable flexible liner 34, the spout 228 may be removed and the permeable flexible liner 34 may be sealed. This construction for the permeable flexible liner 34 is versatile (as shown by this alternative configuration). The construction for various sizes and shapes of shoes (or other protective coverings) is possible since the permeable flexible liner 34 may be filled with more or less absorbing material 30 based on the size and shape of the shoe 2 the preserver 10 is intended to be inserted within.

Referring back to FIG. 43, the absorbing material 30 is filled through the opening 221 in the outwardly widened toe end 22 of the extended material flap 222 in the permeable flexible liner 34. The absorbing material 30 is filled to a predetermined volume which may be varied on a variety of factors, such as the size and shape of an intended shoe, the presence or absence of a bladder, as well as a variety of other factors. Once the predetermined amount of absorbing material 30 has been filled within the permeable flexible liner 34, the toe end 22 of the permeable flexible liner 34 may be stitched 8 and/or rolled prior to stitching.

It is to be understood that the extended material flap 222 may be disposed at any position along the permeable flexible liner 34 in order to allow the absorbing material 30 to be filled therein. For exemplary purposes, in FIG. 45, an extended material flap 222*a* having an opening 221*a* is shown extending from the side of the permeable flexible liner 34 to allow the entry and filling of the absorbing material 30. As such, it the extended material flap 222*a* and the opening 221*a* may be disposed at any location on the permeable flexible liner 34 in accordance with this invention. Likewise, similar construction may be used for filling the permeable flexible covering 20 with the permeable flexible liner 34, as briefly mentioned in FIG. 21.

As shown in FIGS. 44-45, in order to compact the absorbent material 30 within the permeable flexible liner 34, the extended material flap 222 and the opening 221 is sequentially folded over causing the absorbing material 30 disposed within to be substantially compacted within the flexibly expanding permeable flexible liner 34. Likewise, the folded material 220 of the extended material flap 222 eventually builds up a substantial thickness forming the mass of material 224 at the toe end 22 which is built up to form the contour of the forefoot of the preserver 10. The built up mass of material 224 effectively eliminates any gaps 227 from forming between the permeable flexible liner 34 and the toe portion 225 of the preserver 10.

In more detail, FIG. 44 shows the opening 221 of the extended material flap 222 being folded back toward the heel end 24 of the permeable flexible liner 34. As the opening 221 of the extended material flap 222 is continually folded back, the mass of material 224 is gradually built up at the toe end 22 of the permeable flexible liner 34 and the contour of the forefoot of a human foot is thereby formed.

FIG. 45 shows the opening 221 and the extended material flap 222 at the toe end 22 of permeable flexible liner 34 folded to a desired predetermined location. As such, the mass of material 224 formed from the folded extended material flap 222 is contoured into a widened forefoot mass built up at the toe end 22 of the flexible liner permeable flexible liner 34 that resembles the human forefoot.

Figure 49:
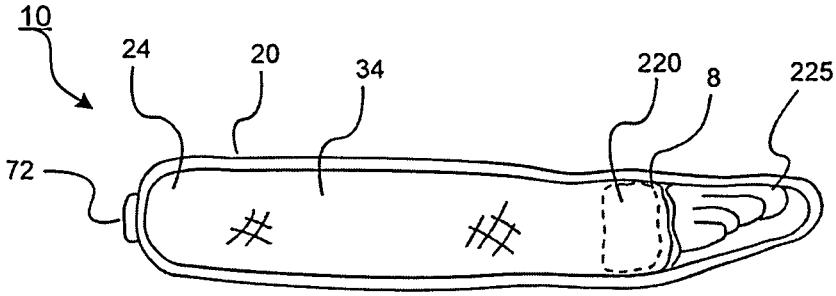

FIGS. 47-49 illustrates the widened forefoot mass of material 224 at the edge 22*a* of the toe end 22 of the permeable flexible liner 34 is as wide as the edges 225*a* of the toe portion 225. Consequently, no gap 227 (as shown in FIG. 42) is formed between the widened forefoot mass of material 224 and the toe portion 225 end absorption material since the edges 225*a* of the toe portion 225 are substantially the same width as the edge 22*a* of the toe end 22 of the permeable flexible liner 34. Together, the permeable flexible liner 34 and the toe portion 225 and its absorption material substantially fill the permeable flexible covering 20 as shown in FIGS. 48 and 49. The benefit of this construction is a better fit within the permeable flexible covering 20 and within the shoe such that when the permeable flexible covering 20 is inserted into the shoe 2, a maximum amount of moisture absorption is enhanced and removed from the interior surface area 4 of the shoe because the entire permeable flexible covering 20 will be in contact the interior surface areas 4 of the shoe 2.

Also shown in FIGS. 47-49, it is to be understood that the toe portion 225 may be formed in the shape of toes. The toe portion 225 may be secured within the toe end 22 of the permeable flexible covering 20 by stitching 8 the toe portion 225 into position and shape. In such a construction, the toe portion 225 and the permeable flexible liner 34 act together to absorb any moisture disposed within the shoe 2. The toe portion 225 may be integrated within the permeable flexible liner 34 adjacent to the absorbing material 30. The toe portion 225 may be separated from the absorbing material 30 but within the permeable flexible liner 34. The separation may be stitched 8, a bond, and/or any other type of separator and/or adhesive capable of separating the toe portion 225 from the absorbing material 30. Alternatively, the toe portion 225 may be secured in a removable manner so that the toe portion 225 can be replaced as necessary without replacing the absorbing material 30 or permeable flexible liner 34.

Figure 50:
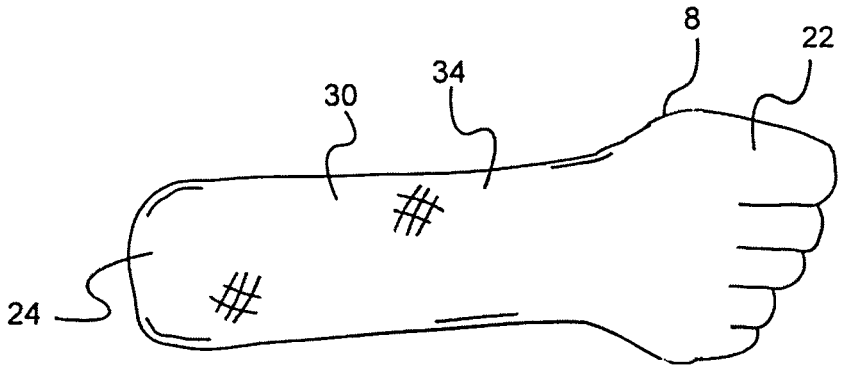
FIGS. 50-51 illustrate other exemplary shapes the permeable flexible liner may take in accordance with this invention.
Figure 51:
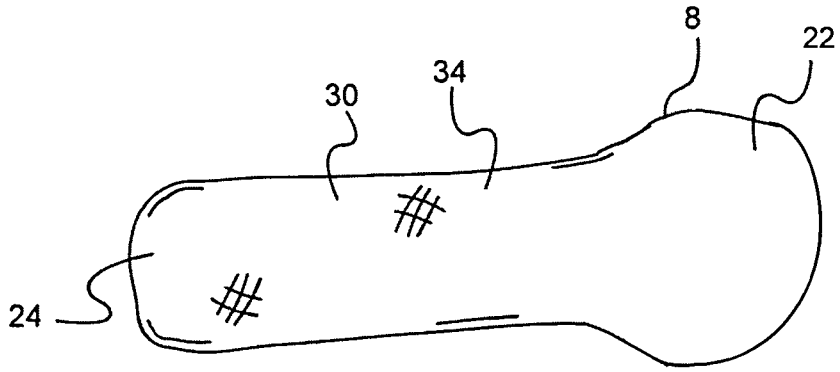

FIGS. 50-51 shows that it is to be further understood that the permeable flexible liner 34 may be constructed in a plurality of different shapes in addition to the other shapes shown. In particular, the permeable flexible liner 34 may be designed in the shape of a unitary integrate contoured foot with or without toes being constructed in the toe end 22 of the permeable flexible liner 34. In both illustrations, the permeable flexible liner 34 is filled with an absorbing material 30 from the heel end 24 to the toe end 22 of the permeable flexible liner 34. With this construction, the permeable flexible liner 34 can easily be replaced without having to replace the permeable flexible covering 20.

Figure 52:
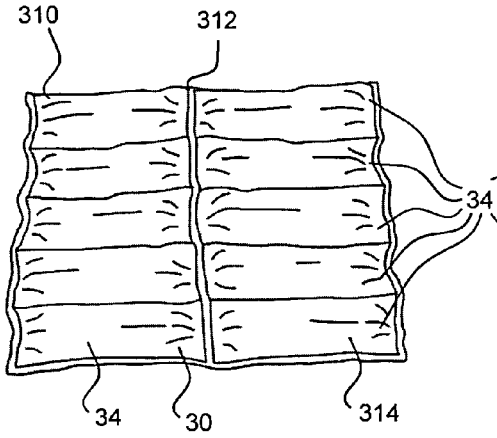
FIGS. 52-53 depict a permeable flexible liner constructed as a one-piece modular sheet having a number of various contiguous permeable flexible liners attached to each other.
Figure 53:
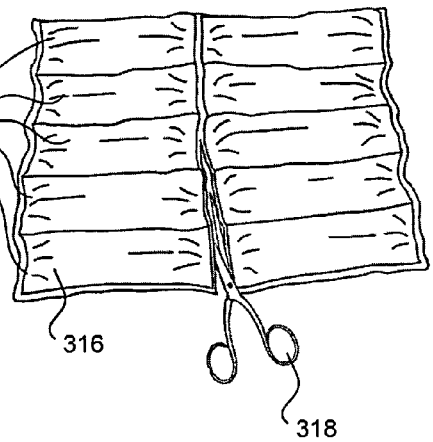

FIGS. 52-53 depict yet another aspect of this invention in which the permeable flexible liner 34 and the absorbing material 30 disposed therein is constructed as a one-piece separable and modular sheet 310 constructed by a number of various contiguous permeable flexible liners 34 attached to each other. The modular sheet 310 includes a plurality of pouches 334 that make up the various permeable flexible liners 34.

As before, it is important to understand that the advantage of incorporating the modular sheet 310 within the modular preserver system is to be able to extend the life of the modular preserver system by caring for the various individual components of the system, and being able to reuse them individually. Since the absorbing material 30 in the modular sheet 310 is a self contained unit, the various other components of the modular preserver system can be disassembled, separately washed and/or cleaned thereby increasing the life expectancy and efficiency of the various individual components of the modular preserver system in accordance with this invention.

FIG. 52 discloses a front view of the modular sheet 310 of permeable flexible liners 34, FIG. 53 depicts a rear view of the modular sheet 310 of permeable flexible liners 34. The modular sheet 310 may be formed in a plurality of ways. For exemplary purposes, the modular sheet 310 may be made up of a first expandable panel of material 314 (as shown in FIG. 52), and a second panel of material 316 (as shown in FIG. 53). The various pouches 334 that make up the permeable flexible liners 34 are connected to each other at a seam or joint 312. The various materials used for the modular sheet 310 may be selected from any of the various materials described above with respect to the permeable flexible covering 20 and permeable flexible liner 34 of this invention.

Figure 54:
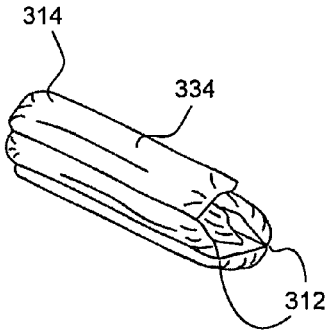
FIG. 54 shows the flexibility of the various pouches of the modular sheet being compactly rolled for modular use.

FIG. 54 shows the flexibility of the modular sheet 310. The joints 312 in the modular sheet 310 between each of the pouches 334 is sufficiently durable to hold the various pouches 334 together, while flexible enough to allow the various pouches 334 to pivot and/or bend relative to each other so that the modular sheet 310 can be compactly rolled like a sheet for modular use.

The joints 312 defining the various individual pouches 334 are not limited to being formed by stitching, but may be formed in a variety of different ways including being glued, welded, bonded and/or any other method for securing two panels of fabric together in accordance with this invention.

Figure 55:
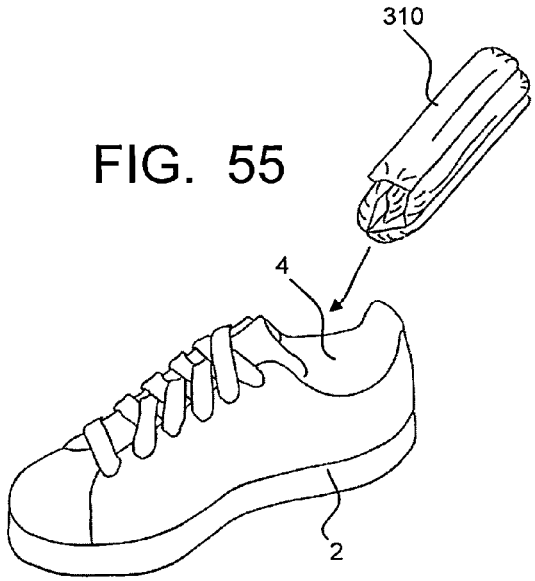
FIG. 55 demonstrates the modular sheet rolled and placed into a shoe.

FIG. 55 demonstrates an exemplary use for the modular sheet 310. As shown, the modular sheet 310 is rolled and placed into a shoe 2. The advantage of this embodiment is that the modular sheet 310 can be modified to fit within, or outside of, a variety of different size shoes 2 and protective coverings. As shown in FIG. 53, the modular sheet 310 can be cut by a cutting implement 318 to a desired size, such as in FIG. 55 to fit within the shoe 2 rolled up to fill the interior surface area 4 of the shoe 2.

It is important to realize that the use of the flexible modular sheet 310 is agnostic among a variety of different protective coverings 302 because the protective covering 302 is versatile in the size and shape that the modular sheet 310 can be cut down to and manipulated to fit within a variety of different size spaces. For example, the modular sheet 310 can be cut short, rolled tight into a small roll and placed within a narrow confinement of a glove. On the other hand, the modular sheet 310 can be used in a larger quantity and rolled to fit within a larger area, such as the opening and internal compartment of a helmet. Likewise, the other advantages realized employing the modular sheet 310 is the ability to enclose a protective covering 302 within the modular sheet 310 and draw moisture from the outside of the protective covering 302 as well as will be described in more detail below. Clearly, the modular sheet 310 has numerous widespread applications, for example, withdrawing the moisture from shoes, boots, gloves, helmets, shin guards, head bands, wrestling head gear, and any other type of protective covering 302 or gear that collects moisture.

FIG. 56 shows another exemplary embodiment for use with the modular sheet 310. In this example, a length of cloth 320, such as a towel, includes a pocket 322. A piece of the modular sheet 310 is shown cut down (such as in FIG. 53) and placed into the pocket 322. By employing the modular sheet 310 with the cloth 320, the modular sheet 310 can be later separated and the cloth 320 can be separately washed and cleaned as will become apparent in the exemplary embodiments below.

Figure 61:
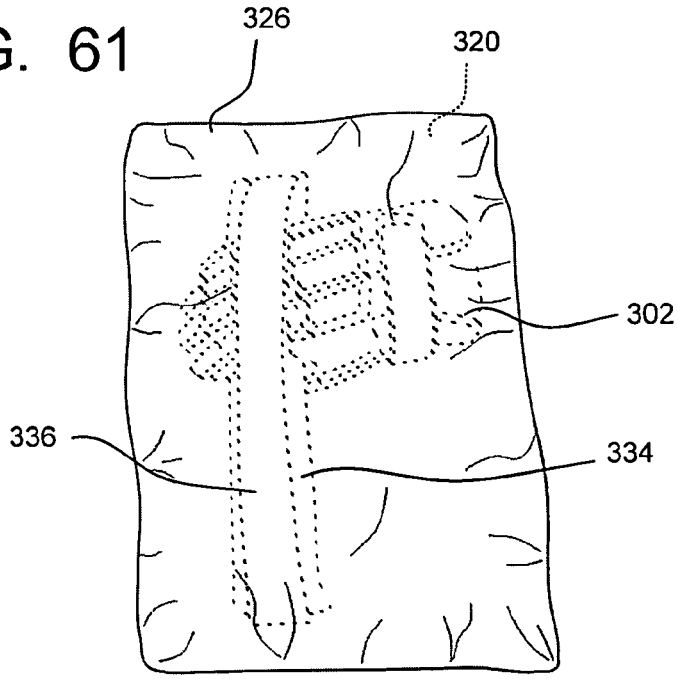

As shown, the cloth 320 may include a water resistant panel 324. The advantage of providing the water resistant panel 324 is to provide an environment that traps moisture within the interior of the enclosed modular sheet 310 and/or the water proof cloth 320. As shown in FIG. 61, when the enclosure and/or container 326, the modular sheet 310 and/or the water proof cloth 320 is closed over the protective covering 302 a moisture enclosed environment is created. As such, the absorbing material 30 disposed within the walls of the container 326, within the pouch 334, and/or within the modular sheet 310 is capable of drawing the maximum amount of moisture from the soiled protective covering 302 because the moisture is locked within the moisture enclosed environment. As a result, all of the moisture will flow from the soiled protective covering 302 into the absorbing material 30 in an accelerated manner as there is no where else the moisture can travel outside of the moisture locked environment.

Various advantages are provided by this exemplary embodiment. Since the outer panels of the container 326, modular sheet 310 and/or cloth 320 trap moisture within the interior of the various enclosures, the various enclosures can be safely stored without soiling areas surrounding the enclosure, such as a car, a closet and/or any other location. While in use, the moisture within the enclosure is prevented from seeping out of the enclosure and across the across the fabric. As shown in use in FIG. 57, a soiled protective covering 302, such as a glove, may be placed within the cloth 320 and over the moisture absorbing modular sheet 310. The cloth 320 may then be folded over the protective covering 302 so that the protective covering comes into contact with the moisture absorbing modular sheet 310. The immediate contact between the protective covering 302 and the modular sheet 310 will cause the moisture within the protective covering 302 to be drawn out of the protective covering 302 and into the modular sheet 310. Therefore, the protective covering 302 will be dried as a result of the accelerated moisture being drawn from the protective covering 302 into the modular sheet 310.

Although shown as a cloth 320, it is to be understood that the cloth 320 may be any type of enclosure such as a bag, a container 326 (as shown in FIG. 61) and/or any type of sub-enclosure.

Sporting enthusiasts will find substantial use with this exemplary embodiment. The sporting enthusiast will be able to place a modular sheet 310 into the cloth 320 and wrap up their soiled articles of clothing in the cloth 320 and have their soiled articles dried in an accelerated manner than was ever possible conventionally.

Figure 58:
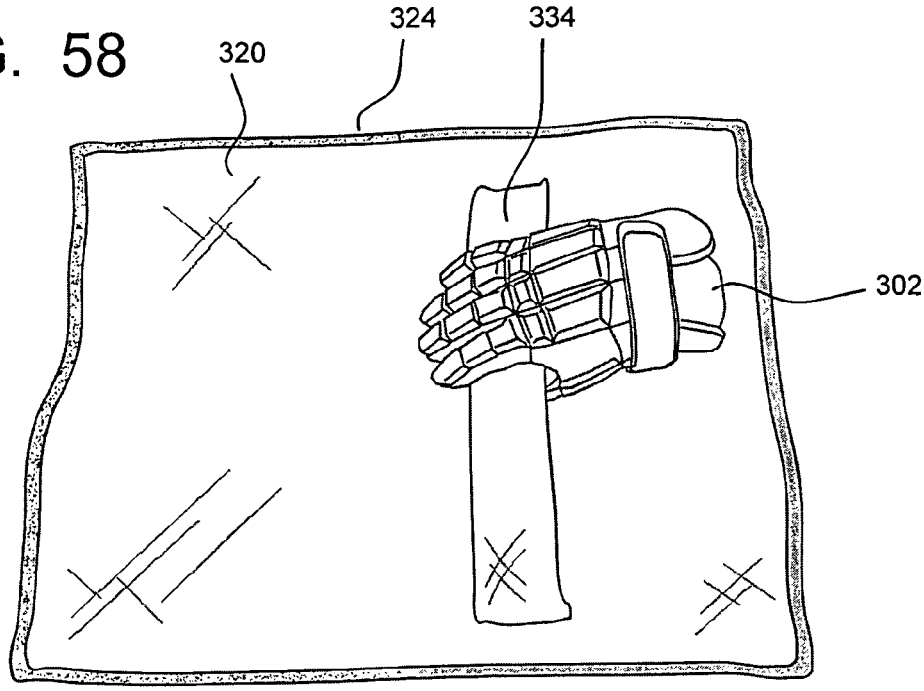
FIGS. 58 and 59 illustrate the modular sheet cut down into a small permeable flexible liner pouch onto which the finger of the protective covering can be wrapped around.
Figure 59:
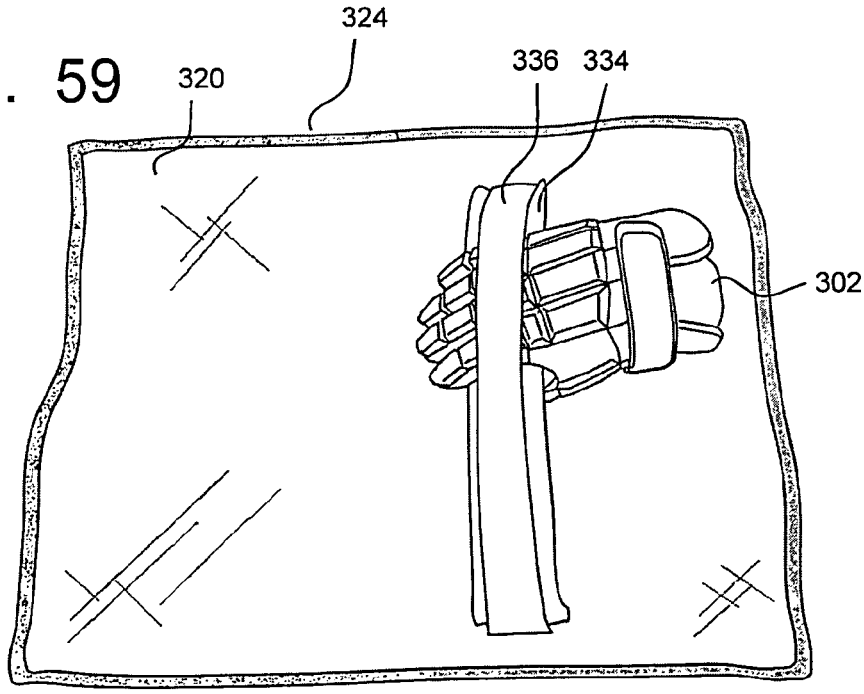

FIGS. 58 and 59 illustrate another example in which the modular sheet 310 is cut down into a small permeable flexible liner pouch 334 onto which the finger of the protective covering 302 can be wrapped around. FIG. shows a simplified depiction of the fingers of the protective covering protective covering 302 being wrapped around the pouch 334, and FIG. 59 shows the fingers of the protective covering 302 being wrapped around a modified pouch 334 having a securing strap onto which the fingers of the protective covering 302 can be secured.

Figure 60:
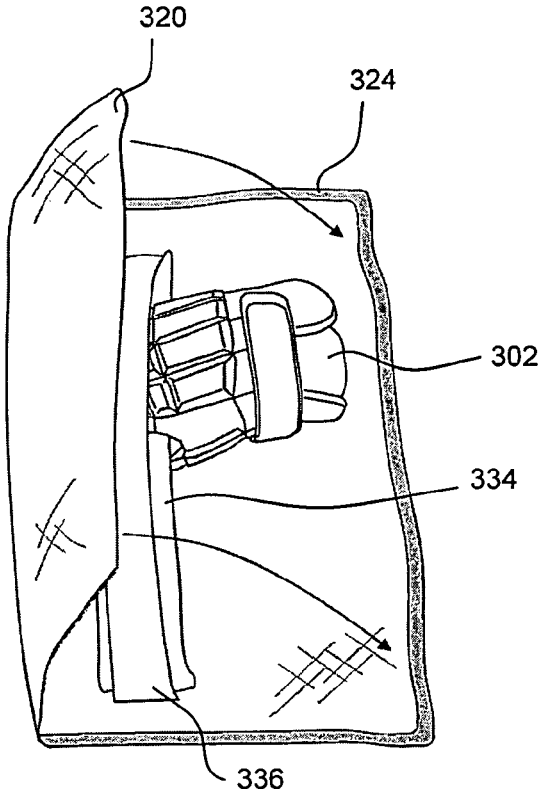
FIGS. 60-61, shows the soiled protective covering placed within the folded cloth and being gripped to, and secured by, a strap on a pouch.

FIG. 60, shows as before shown in FIG. 57, the soiled protective covering 302 is placed within the cloth 320. In FIG. 61, the cloth 320 is then folded over the protective covering 302 with the permeable flexible liner pouch 334 in its grip and secured by a strap 336 to the pouch 334. The immediate contact between the protective covering 302 with the pouch 334 and the cloth 320 will cause the moisture within the protective covering 302 to be drawn out of the protective covering 302 and into the moisture absorbing pouch 334. Therefore, the protective covering 302 will be dried as a result of the accelerated moisture being drawn from the protective covering 302 into the modular sheet 310.

Figure 62:
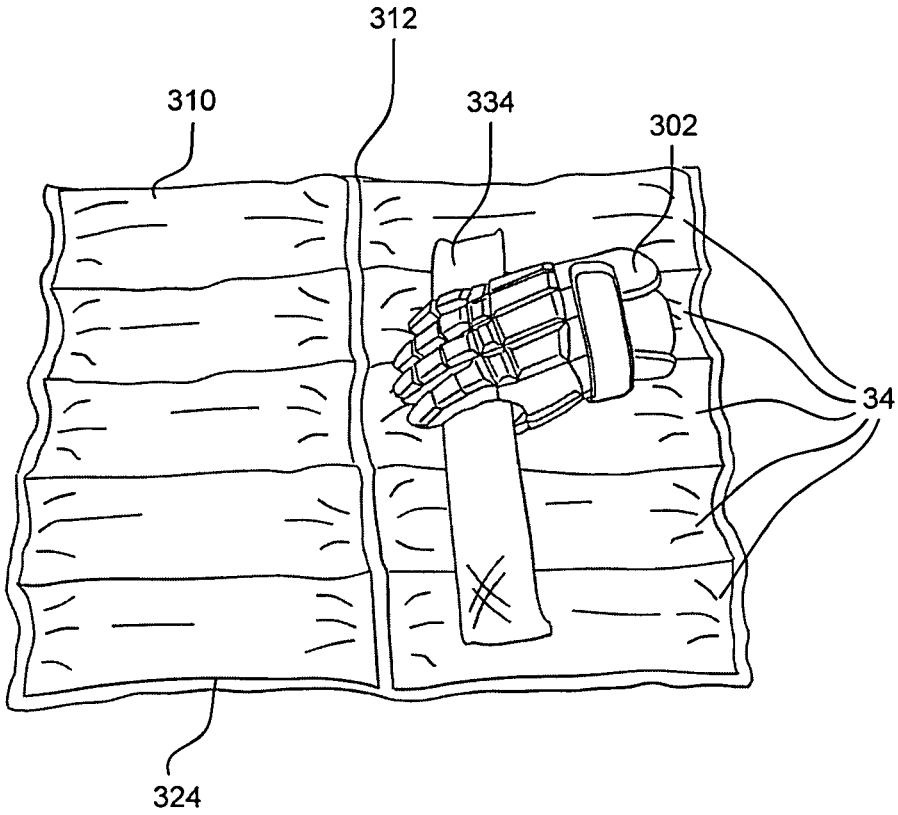
FIG. 62 shows a permeable flexible liner pouch cut down to fit comfortably within the grip of the protective covering, and the protective covering being placed within the modular sheet.

FIG. 62 shows an alternative exemplary embodiment in which the cloth 320 is replaced with the moisture absorbing modular sheet 310. Here, a permeable flexible liner pouch 334 has been cut down to fit comfortably within the grip of the protective covering 302, and the protective covering 302 is grasping onto the pouch 334 and is placed within the modular sheet 310. As in FIGS. 57 and 60, the soiled protective covering 302, may be placed within the modular sheet 310.

The modular sheet 310 may then be folded over the protective covering 302 so that the protective covering 302 is compressed against and comes into contact with the moisture absorbing modular sheet 310 as well as the pouch 334 as it is wrapped within the modular sheet 310. In this manner, immediate contact between the protective covering 302, the permeable flexible liner pouch 334 and the modular sheet 310 will cause the moisture within the protective covering 302 to be drawn out of the protective covering 302 at an accelerated pace and into the modular sheet 310 and the pouch 334 within the clasp of the protective covering 302. As such, the entire outer surface area of the protective covering 302 will be in contact with the accelerated moisture absorbing properties of both the modular sheet 310 and the pouch 334. It is also possible to cut down another portion of the modular sheet 310 and place it within the interior surface areas of the protective covering 302.

It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. A construction for a modular moisture absorbing shoe preserver system having interchangeable components, comprising:

a preserver adapted to snugly fit within a shoe, including:

a permeable covering having an opening;

a replaceable toe portion disposed within the permeable covering defining a forward toe portion of the preserver;

a replaceable permeable liner disposed within the permeable covering, wherein the replaceable permeable liner is constructed from a moisture absorbing permeable material having a closed heel end and an open toe end; and an absorbing material disposed within the replaceable permeable liner to withdraw moisture from an interior surface area of the shoe through the permeable covering, where, in construction of the replaceable permeable liner the open toe end of the replaceable permeable liner is folded back toward the closed heel various times and secured closed defining a forefoot end having a material mass substantially thicker and wider than the closed heel end of the permeable liner to resemble the shape of a foot, a forefoot end of the replaceable permeable liner disposed adjacent to the forward toe portion of the replaceable toe portion.

2. The construction for the modular moisture absorbing shoe preserver system as recited in claim 1, wherein a cross section of the replaceable permeable liner is substantially similar in shape and flush with a cross section of the replaceable toe portion in order to reduce any gaps and to maximize the contact with all surface areas within the shoe.

3. The construction for the modular moisture absorbing shoe preserver system as recited in claim 2, wherein a peripheral edge of the forefoot end of the replaceable permeable liner is positioned adjacent to and aligned substantially flush with a peripheral edge of the replaceable toe portion.

4. The construction for the modular moisture absorbing shoe preserver system as recited in claim 1, wherein the open toe end has an extended material flap that widens outward.

5. The construction for the modular moisture absorbing shoe preserver system as recited in claim 1, wherein the replaceable toe portion is disposed within the replaceable permeable liner and positioned adjacent to the absorbing material.

6. The construction for the modular moisture absorbing shoe preserver system as recited in claim 1, wherein the replaceable toe portion is disposed outside of, but adjacent to, the replaceable permeable liner.

7. The construction for the modular moisture absorbing shoe preserver system as recited in claim 1, further comprising a flexible strap adapted to carry at least one shoe.

8. The construction for the modular moisture absorbing shoe preserver system as recited in claim 1, wherein the opening in the permeable covering can be selected from at least one of a zipper, a slot, a hook and eye closure, and a first and second overlapping panel enclosure.

9. A modular moisture absorbing shoe preserver system having a preserver with interchangeable components, comprising:

a replaceable permeable covering having an opening;

a replaceable permeable liner disposed within the replaceable permeable covering, the replaceable permeable liner constructed from a fabric moisture absorbing permeable material having an extended material flap opening extending away from the replaceable permeable liner;

an absorbing material, disposed within the extended material flap opening, and adapted to withdraw moisture from an interior surface area of a shoe through the replaceable permeable covering, wherein when the absorbing material has been filled within the extended material flap opening of the replaceable permeable liner to a predetermined volume, the extended material flap opening is folded back toward the replaceable permeable liner and secured close to define a material mass that resembles the shape of a foot; and a replaceable toe portion defining a toe portion of the preserver.

10. The modular moisture absorbing shoe preserver system recited in claim 9, wherein the replaceable permeable liner is a self-contained unit disposed adjacent to the toe portion, the replaceable permeable liner resembles the shape of a heel and a blunt forefoot which when disposed adjacent to the toe portion defines a complete contour for a foot.

11. The modular moisture absorbing shoe preserver system recited in claim 10, where, in construction of the replaceable permeable liner an open toe end of the replacement permeable liner is folded back toward the heel various times and secured closed defining the blunt forefoot further defining the material mass substantially thicker and wider than the heel of the replaceable permeable liner further resembling the shape of the foot.

12. The modular moisture absorbing shoe preserver system recited in claim 11, wherein a cross section of the replaceable permeable liner is substantially similar in shape and flush with a cross section of the replaceable toe portion in order to reduce any gaps and to maximize the contact with all surface areas within the shoe.

13. The construction for the modular moisture absorbing shoe preserver system as recited in claim 12, wherein a peripheral edge of the forefoot end of the replaceable permeable liner is positioned adjacent to and aligned substantially flush with a peripheral edge of the replaceable toe portion.

14. The modular moisture absorbing shoe preserver system recited in claim 9, wherein the extended material flap opening is located at any position on the replaceable permeable liner.

15. The modular moisture absorbing shoe preserver system recited in claim 9, wherein the opening in the replaceable permeable covering can be selected from at least one of a zipper, a slot, a hook and eye closure, and a first and second overlapping panel enclosure.

* * * * *